US008418785B2

(12) United States Patent
Azar

(10) Patent No.: US 8,418,785 B2
(45) Date of Patent: Apr. 16, 2013

(54) FIXED CUTTER BIT FOR DIRECTIONAL DRILLING APPLICATIONS

(75) Inventor: Michael G Azar, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 342 days.

(21) Appl. No.: 12/761,593

(22) Filed: Apr. 16, 2010

(65) Prior Publication Data

US 2011/0100724 A1 May 5, 2011

Related U.S. Application Data

(60) Provisional application No. 61/169,911, filed on Apr. 16, 2009.

(51) Int. Cl.
*E21B 10/42* (2006.01)
*E21B 10/56* (2006.01)
*E21B 10/633* (2006.01)

(52) U.S. Cl.
USPC ..... 175/430; 175/420.1; 175/420.2; 175/431

(58) Field of Classification Search ..... 175/414, 175/420.1, 420.2, 430, 431
See application file for complete search history.

(56) References Cited

U.S. PATENT DOCUMENTS

| | | | |
|---|---|---|---|
| 4,858,707 | A | 8/1989 | Jones |
| 4,889,017 | A | 12/1989 | Fuller |
| 4,981,184 | A | 1/1991 | Knowlton |
| 4,984,642 | A | 1/1991 | Renard |
| 5,332,051 | A | 7/1994 | Knowlton |
| 5,351,772 | A | 10/1994 | Smith |
| 5,505,273 | A | 4/1996 | Azar |
| 6,065,554 | A | 5/2000 | Taylor |
| 6,145,608 | A | 11/2000 | Lund |
| 6,196,340 | B1 | 3/2001 | Jensen |
| 6,283,234 | B1 | 9/2001 | Torbet |
| 6,302,224 | B1 | 10/2001 | Sherwood, Jr. |
| 6,394,198 | B1 | 5/2002 | Hall |
| 6,405,814 | B1 | 6/2002 | Eyre |
| 7,455,126 | B2 | 11/2008 | Cruz |
| 2006/0070771 | A1 | 4/2006 | McClain et al. |
| 2006/0131075 | A1 | 6/2006 | Cruz |
| 2006/0283640 | A1 | 12/2006 | Estes et al. |
| 2007/0261890 | A1 | 11/2007 | Cisneros |
| 2008/0006448 | A1 | 1/2008 | Zhang et al. |
| 2008/0105466 | A1 | 5/2008 | Hoffmaster et al. |
| 2008/0149393 | A1 | 6/2008 | McClain et al. |
| 2009/0084606 | A1 | 4/2009 | Doster |
| 2009/0145663 | A1 | 6/2009 | Durairajan |

FOREIGN PATENT DOCUMENTS

| | | | |
|---|---|---|---|
| EP | 0370717 | B1 | 9/1993 |

OTHER PUBLICATIONS

International Search Report and Written Opinion dated Nov. 30, 2010 for corresponding PCT application No. PCT/US2010/031370 filed Apr. 16, 2010.

*Primary Examiner* — Cathleen Hutchins

(57) ABSTRACT

A drill bit for drilling a borehole in earthen formations, the bit comprising: a bit body having a bit axis and a bit face including a cone region, a shoulder region, and a gage region; a first primary blade extending radially along the bit face from the cone region to the gage region; a plurality of cutter elements mounted to the first primary blade, wherein a first of the plurality of cutter elements has a planar cutting face and a second of the plurality of cutter elements has a convex cutting face; and wherein each cutting face is forward-facing.

26 Claims, 17 Drawing Sheets

FIXED CUTTER BIT FOR DIRECTIONAL DRILLING APPLICATIONS

CROSS-REFERENCE TO RELATED APPLICATIONS

This application claims priority to U.S. Provisional Application No. 61/169,911, filed Apr. 16, 2009, which is hereby incorporated by reference in its entirety.

STATEMENT REGARDING FEDERALLY SPONSORED RESEARCH OR DEVELOPMENT

Not Applicable.

BACKGROUND

1. Field of the Invention

The invention relates generally to earth-boring bits used to drill a borehole for the ultimate recovery of oil, gas, or minerals. More particularly, the invention relates to fixed cutter drill bits for directional drilling. Still more particularly, the invention relates to a fixed cutter bit including shaped cutter elements to selectively control depth of cut and bit aggressiveness.

2. Background of the Invention

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Many different types of drill bits and cutting structures for bits have been developed and found useful in drilling such boreholes. Two predominate types of rock bits are roller cone bits and fixed cutter (or rotary drag) bits. Many fixed cutter bit designs include a plurality of blades that project radially outward from the bit body and form flow channels there between. Typically, cutter elements are grouped and mounted on the several blades.

The cutter elements disposed on the several blades of a fixed cutter bit are typically formed of extremely hard materials and include a layer of polycrystalline diamond ("PCD") material. In the typical fixed cutter bit, each cutter element or assembly comprises an elongate and generally cylindrical support member which is received and secured in a pocket formed in the surface of one of the several blades. A cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PCD bit" or "PCD cutter element" refers to a fixed cutter bit or cutter element employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may inhibit or prevent the penetration of the cutting structure into the formation. In addition, the fluid removes cut formation materials from the bottom of the borehole. Failure to remove formation materials from the bottom of the borehole may result in subsequent passes by the cutting structure to re-cut the same materials, thus reducing cutting rate and potentially increasing wear on the cutting surfaces. The drilling fluid and cuttings removed from the bit face and from the bottom of the borehole are forced and carried to the surface through the annulus that exists between the drill string and the borehole sidewall. Still further, the drilling fluid removes frictional heat from the cutter elements in order to prolong cutter element life. Thus, the number and placement of drilling fluid nozzles, and the resulting flow of drilling fluid, may significantly impact the performance of the drill bit.

Most conventional cutter elements include a planar cutting face that presents a relatively aggressive cutting edge to the formation. Although aggressive cutter elements tend to enhance ROP, they can trigger other less desirable results in both directional and conventional drilling applications.

Depending on the location and orientation of the target formation or pay zone, directional (e.g., horizontal drilling) with the drill bit may be desired. In general, directional drilling involves deviation of the borehole from vertical (i.e., drilling a borehole in a direction other than substantially vertical), and is typically accomplished by drilling, for at least some period of time, in a direction not parallel with the bit axis. Directional drilling capabilities have improved as advancements in measurement while drilling (MWD) technologies have enabled drillers to better track the position and orientation of the wellbore. In addition, more extensive and more accurate information about the location of the target formation as a result of improved logging techniques has enhanced directional drilling capabilities. As directional drilling capabilities have improved, so have the expectations for drilling performance. For example, a driller today may target a relatively narrow, horizontal oil-bearing stratum, and may wish to maintain the borehole completely within the stratum. In some complex scenarios, highly specialized "design drilling" techniques with highly tortuous well paths having multiple directional changes of two or more bends lying in different planes may be employed.

One common method to control the drilling direction of a bit is to steer the bit using a downhole motor 6 with a bent sub 4 and/or housing. As shown in FIG. 1, a simplified version of a downhole steering system according to the prior art comprises a rig 1, a drill string 2 having a downhole motor 6 with a bent sub 4, and a conventional fixed cutter drill bit 8. Motor 6 and bent sub 4 form part of the bottomhole assembly (BHA) and are attached to the lower end of the drill string 2 adjacent the conventional drill bit 8. When not rotating, the bent sub 4 causes the bit face to be canted with respect to the tool axis. The downhole motor 6 is capable of rotating conventional drill bit 8 without the need to rotate the entire drill string 2. For example, downhole motor 6 may be a turbine, an electric motor, or a progressive cavity motor that converts drilling fluid pressure pumped down drill string 2 into rotational energy at drill bit 8. When downhole motor 6 is used with bent sub 4 without rotating drill string 2, drill bit 8 drills a borehole that is deviated in the direction of the bend or curve in the bent sub 4. On the contrary, when the drill bit is rotated by rotating the drill string, the borehole normally maintains a linear path or direction generally along the projection of the drill string longitudinal axis, even when a downhole motor is used, since the bent sub or housing rotates along with the drill string, and thus, no longer orients the drill bit in a specific direction. Consequently, a combination of a bent sub or housing and a downhole motor to rotate the drill bit without rotating the drill string generally provides a more effective means for deviating a borehole.

In most cases, directional drilling is accomplished by alternating the rotation of drill bit 8 between drill string 2 and downhole motor 6. While rotating drill bit 8 with drill string 2 and motor 6, commonly referred to as the "rotating mode," bit 8 proceeds to form a relatively straight borehole generally aligned with the longitudinal axis of drill string 2. However, when rotating drill bit 8 with downhole motor 6 and not drill string 2, commonly referred to as the "steering mode" or "sliding mode," the bent sub 4 causes the drill bit 8 to proceed to form a borehole oriented at an angle relative to the longitudinal axis of drill string 2. By alternating between the rotating mode and steering mode (i.e., alternating between the rotation of drill bit 8 between drill string 2 and downhole motor 6), a curved (i.e., non-linear) borehole may be formed.

Directional drilling often results in increased engagement and associated frictional forces between the low side of the drill string and the borehole sidewall. In particular, as the inclination of the well increases towards horizontal, it becomes more difficult to apply weight on bit (WOB) effectively since the borehole bottom is no longer aligned with the force of gravity—increasing bends in the drill string tend to reduce the amount of downward force applied to the string at the surface that is translated to WOB acting at the bit face. Consequently, directional drilling with a combination of a downhole motor and a bent sub may decrease the effective WOB. In addition, where the drill string is not rotating, or is rotated very little, such as during the steering mode in directional drilling applications, the rotational shear acting on the drilling fluid in the annulus between the drill string and borehole wall is decreased, as compared to a case where the entire drill string is rotating. Since drilling fluids tend to be thixotropic, the reduction or complete loss of the shearing action tends to adversely affect the ability of the drilling fluid to flush and carry away cuttings from the borehole. As a result, in deviated holes drilled with a downhole motor and bent sub, formation cuttings are more likely to settle out of the drilling fluid on the bottom or low side of the borehole. This may increase borehole drag, making weight-on-bit transmission to the bit even more difficult, and often resulting in tool face control and prediction problems. To overcome the increased frictional forces and provide sufficient effective WOB for drilling, weight applied to the drill string at the surface is steadily increased, in a process commonly referred to as "weight stacking," until the frictional forces between the drill string and borehole sidewall are overcome. Predicting the weight at which the frictional forces will be overcome is very difficult, if not impossible. Consequently, the drill string and drill bit often unexpectedly and abruptly shift. When the drill bit suddenly advances axially into engagement with the borehole bottom under the substantial WOB, the cutter elements in the cone and shoulder regions of the drill bit penetrate the formation to a large depth-of-cut, thereby increasing the torque demands on the downhole motor. If the torque required to drill at the increased depth-of-cut exceeds the downhole motor threshold, the downhole motor may undesirably stall.

In directional and conventional drilling applications, most fixed cutter bits vibrate and/or move laterally relative to the bit axis. During such lateral movements, the cutter elements at gage impact and engage the borehole sidewall, resulting in some lateral cutting into the borehole sidewall. The lateral cutting into the borehole sidewall may increase the diameter of the borehole and potentially cause the drill bit to deviate from its drilling path and initiate damaging vibrations such as bit whirl.

Accordingly, there remains a need in the art for a drill bit including depth-of-cut limiting features and that selectively control the aggressiveness of the bit in specific regions of the bit. Such drill bits would be particularly well received if they did not substantially decrease bit ROP.

BRIEF DESCRIPTION OF THE DRAWINGS

For a more detailed description of the preferred embodiments, reference will now be made to the accompanying drawings, wherein.

DETAILED DESCRIPTION OF SOME OF THE PREFERRED EMBODIMENTS

Figure 1:
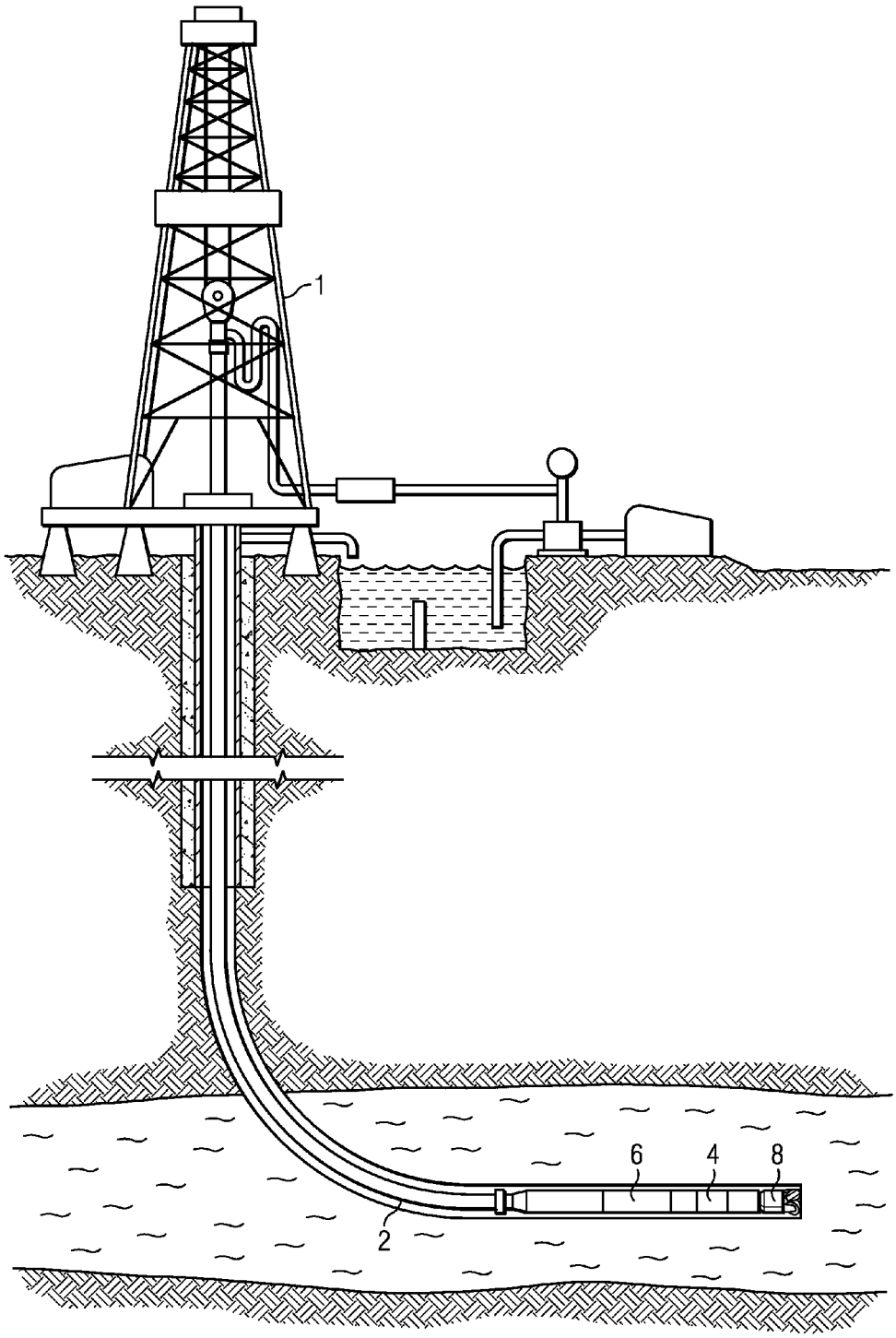
FIG. 1 (PRIOR ART)
FIG. 1 is a schematic view of a conventional directional drilling system.

The following discussion is directed to various embodiments. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names.

This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Figure 2:
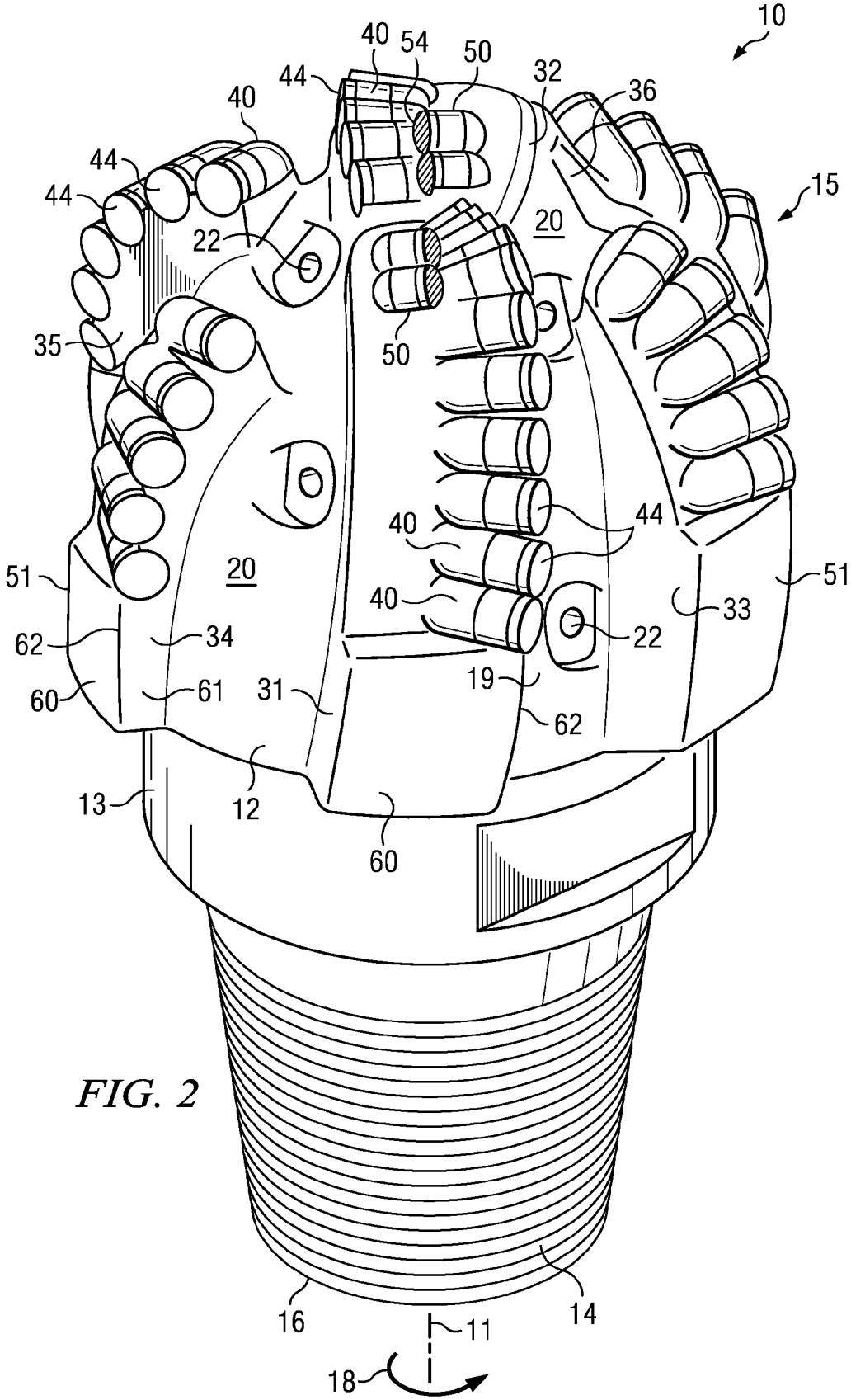
FIG. 2 is a perspective view of an embodiment of a bit made in accordance with the principles described herein.
Figure 3:
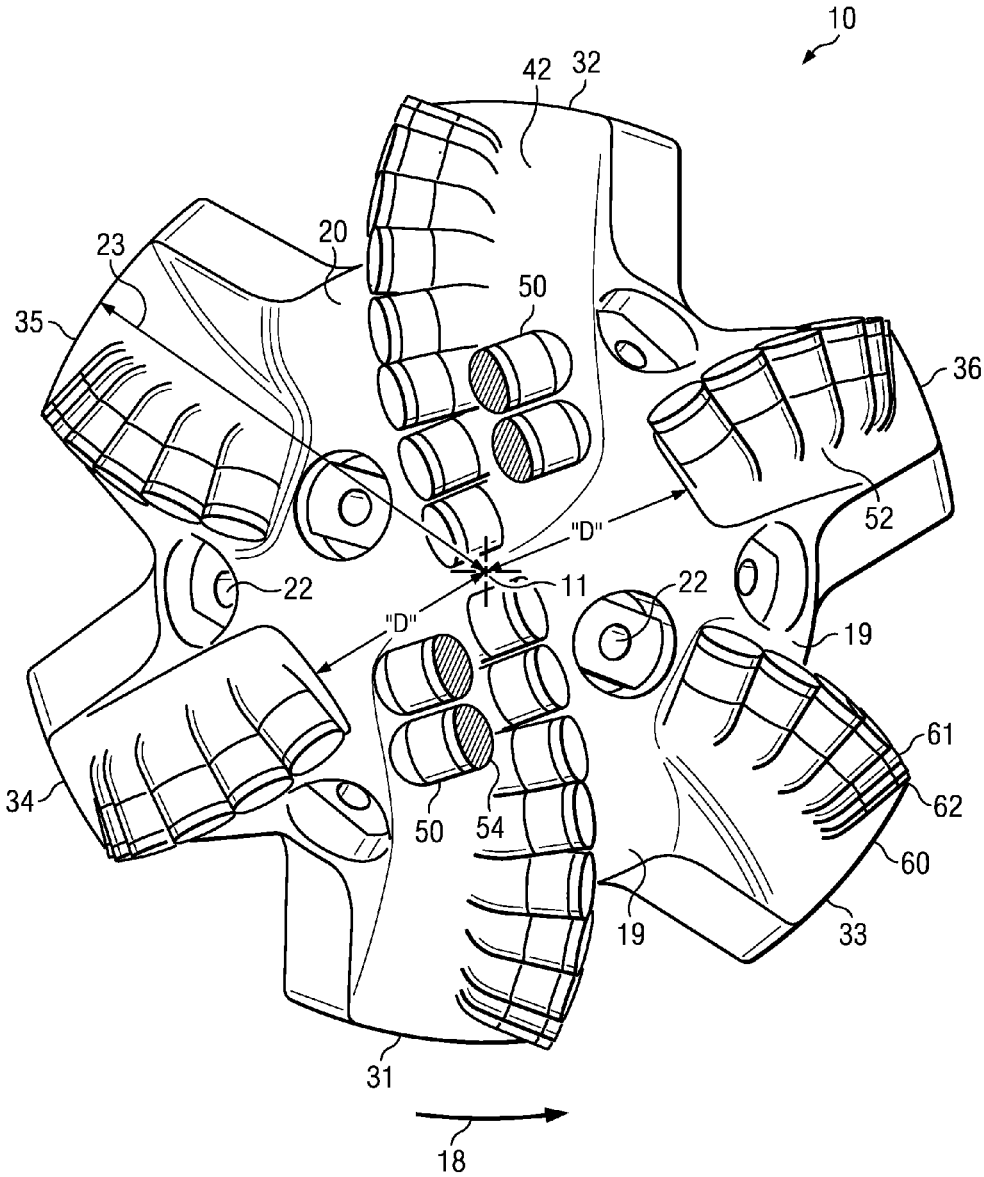
FIG. 3 is a top view of the bit shown in FIG. 2.

Referring now to FIGS. 2 and 3, exemplary bit 10 is a fixed cutter bit, sometimes referred to as a drag bit, and is preferably a PDC bit adapted for drilling through formations of rock to form a borehole. Bit 10 generally includes a bit body 12, a shank 13 and a threaded connection or pin 14 for connecting bit 10 to a drill string (not shown), which is employed to rotate the bit in order to drill the borehole. Bit face 20 supports a cutting structure 15 and is formed on the end of the bit 10 that is opposite pin end 16. Bit 10 further includes a central axis 11 about which bit 10 rotates in the cutting direction represented by arrow 18. As used herein, the terms "axial" and "axially" generally mean along or parallel to the bit axis (e.g., bit axis 11), while the terms "radial" and "radially" generally mean perpendicular to the bit axis. For instance, an axial distance refers to a distance measured along or parallel to the bit axis, and a radial distance refers to a distance measured perpendicularly from the bit axis.

Body 12 may be formed in a conventional manner using powdered metal tungsten carbide particles in a binder material to form a hard metal cast matrix. Alternatively, the body can be machined from a metal block, such as steel, rather than being formed from a matrix.

Figure 4:
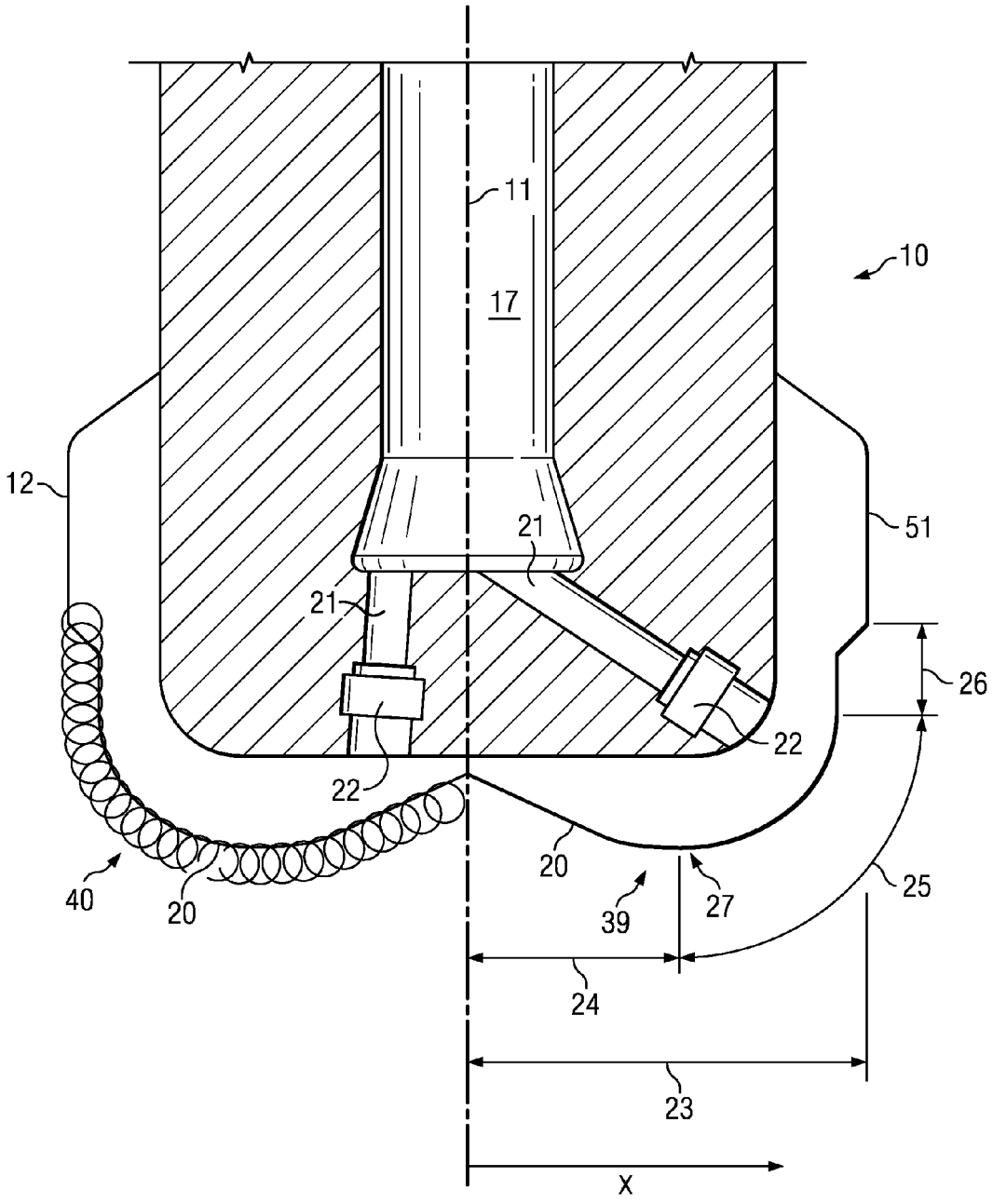
FIG. 4 is a partial cross-sectional view of the bit shown in FIG. 2 with the cutter elements of the bit shown rotated into a single profile.

As best seen in FIG. 4, body 12 includes a central longitudinal bore 17 permitting drilling fluid to flow from the drill string into bit 10. Body 12 is also provided with downwardly extending flow passages 21 having ports or nozzles 22 disposed at their lowermost ends. The flow passages 21 are in fluid communication with central bore 17. Together, passages 21 and nozzles 22 serve to distribute drilling fluids around a cutting structure 15 to flush away formation cuttings during drilling and to remove heat from bit 10.

Referring again to FIGS. 2 and 3, cutting structure 15 is provided on face 20 of bit 10. Cutting structure 15 includes a plurality of blades which extend from bit face 20. In the embodiment illustrated in FIGS. 2 and 3, cutting structure 15 includes two primary blades 31, 32 circumferentially spaced-apart about bit axis 11, and four secondary blades 33-36 circumferentially spaced-apart about bit axis 11. In this embodiment, the plurality of blades (e.g., primary blades 31, 32 and secondary blades 33-36) are uniformly angularly spaced on bit face 20 about bit axis 11. In particular, each blade 31-36 is generally being spaced about 60° from its adjacent blades 31-36. The two primary blades 31, 32 are spaced substantially opposite each other (e.g., about 180° apart). In other embodiments (not specifically illustrated), the blades may be spaced non-uniformly about the bit face. Moreover, although bit 10 is shown as having two primary blades 31, 32 and four secondary blades 33-36, in general, bit 10 may comprise any suitable number of primary and secondary blades. As one example only, bit 10 may comprise two primary blades and four secondary blades.

Still referring to FIGS. 2 and 3, primary blades 31, 32 and secondary blades 33-36 are integrally formed as part of, and extend from, bit body 12 and bit face 20. Primary blades 31, 32 and secondary blades 33-36 extend radially across bit face 20 and longitudinally along a portion of the periphery of bit 10. Primary blades 31, 32 extend radially from substantially proximal central axis 11 toward the periphery of bit 10. Thus, as used herein, the term "primary blade" refers to a blade that begins proximal the bit axis and extends generally radially outward along the bit face to the periphery of the bit. However, secondary blades 33-36 do not extend from substantially proximal central axis 11. Rather, as best seen in FIG. 3, secondary blades 33-36 extend radially from a location that is a distance "D" away from central axis 11 toward the periphery of bit 10. Hence, primary blades 31, 32 extend closer to central axis 11 than secondary blades 33-36. Thus, as used herein, the term "secondary blade" refers to a blade that begins at some distance from the bit axis and extends generally radially along the bit face to the periphery of the bit. Primary blades 31, 32 and secondary blades 33, 34, 35 and 36 are separated by drilling fluid flow courses 19.

As described above, the embodiment of bit 10 illustrated in FIGS. 2 and 3 includes only two relatively longer primary blades (e.g., primary blades 31, 32). As compared to some conventional fixed cutter bits that employ three, four, or more relatively long primary blades, bit 10 has fewer primary blades. By reducing the number of relatively long primary blades, embodiments of the present invention may improve the ROP of bit 10 by reducing the contact surface area, and associated friction, of the relatively long primary blades.

Referring still to FIGS. 2 and 3, each primary blade 31, 32 includes a cutter-supporting surface 42 for mounting a plurality of cutter elements, and each secondary blade 33-36 includes a cutter-supporting surface 52 for mounting a plurality of cutter elements. In particular, a plurality of primary cutter elements 40, each having primary cutting face 44, are mounted to cutter supporting surface 42, 52 of each primary blade 31, 32 and each secondary blade 33-36, respectively. In addition, backup cutter elements 50 are disposed only on the cutter-supporting surface 42 of primary blades 31, 32. In different embodiments (not specifically illustrated), backup cutter elements may also be provided on cutter-supporting surface 52 of secondary blades 33-36. Each cutting face 44, 54 has an outermost cutting tip $\mathbf{44}_T$, $\mathbf{54}_T$, respectively (not specifically illustrated), positioned furthest from cutter-supporting surface 42, 52 to which it is mounted (as measured perpendicularly from its respective cutter-supporting surface 42, 52).

Primary cutter elements 40 are positioned adjacent one another generally in a first row extending radially along each primary blade 31, 32 and along each secondary blade 33-36. Further, backup cutter elements 50 are positioned adjacent one another generally in a second row extending radially along each primary blade 31, 32. Backup cutter elements 50 are positioned behind the primary cutter elements 40 provided on the same primary blade 31, 32. As best seen in FIG. 3, when bit 10 rotates about central axis 11 in the cutting direction represent by arrow 18, backup cutter elements 50 trail the primary cutter elements 40 provided on the same primary blade 31, 32. Thus, as used herein, the term "backup cutter element" is used to describe a cutter element that trails any other cutter element on the same blade when the bit (e.g., bit 10) is rotated in the cutting direction. Further, as used herein, the term "primary cutter element" is used to describe a cutter element provided on the leading edge of a blade. In other words, when the bit is rotated about its central axis in the cutting direction, a "primary cutter element" does not trail any other cutter element on the same blade.

As used herein, the terms "leads," "leading," "trails," and "trailing" are used to describe the relative positions of two structures (e.g., two cutter elements) on the same blade relative to the direction of bit rotation. In particular, a first structure that is disposed ahead or in front of a second structure on the same blade relative to the direction of bit rotation "leads" the second structure (i.e., the first structure is in a "leading" position), whereas the second structure that is disposed behind the first structure on the same blade relative to the direction of bit rotation "trails" the first structure (i.e., the second structure is in a "trailing" position).

In general, primary cutter elements 40 and backup cutter elements 50 need not be positioned in rows, but may be mounted in other suitable arrangements provided each cutter element is either in a leading position (e.g., primary cutter element 40) or trailing position (e.g., backup cutter element 50). Examples of suitable arrangements may include without limitation, rows, arrays or organized patterns, randomly, sinusoidal pattern, or combinations thereof. Further, in other embodiments (not specifically illustrated), additional rows of cutter elements may be provided on a primary blade, secondary blade, or combinations thereof.

As described above, the embodiment of bit 10 illustrated in FIGS. 2 and 3 includes a first row of primary cutter elements 40 and a second row of backup cutter elements 50 on each primary blade 31, 32. Thus, although embodiments of the present invention may provide fewer relatively long primary blades (e.g., primary blades 31, 32) as compared to some conventional fixed cutter bits, the total cutter element count may not be detrimentally reduced since some cutter elements lost by removing one or more primary blades are replaced by adding a second row of cutter elements on each remaining primary blades (e.g., backup cutting elements 50 on primary blades 31, 32).

Still referring to FIGS. 2 and 3, bit 10 further includes gage pads 51 of substantially equal length that are disposed about the circumference of bit 10 at angularly spaced locations. Gage pads 51 intersect and extend from blades 31-36, respectively. Gage pads 51 are integrally formed as part of the bit body 12. Each gage pad 51 includes a generally gage-facing surface 60 and a generally forward-facing surface 61 which intersect in an edge 62, which may be radiused, beveled or otherwise rounded. Gage-facing surface 60 includes at least a portion that extends in a direction generally parallel to bit access 11 and extends to full gage diameter (or outer radius 23). In some embodiments, other portions of gage-facing surface 60 may be angled, and thus slant away from the borehole sidewall. Also, in select embodiments, forward-facing surface 61 may likewise be angled relative to central axis 11 (both as viewed perpendicular to central axis 11 or as viewed along central axis 11). Surface 61 is termed generally "forward-facing" to distinguish that surface from the gage surface 60, which generally faces the borehole sidewall. Gage-facing surface 60 of gage pads 51 abut the sidewall of the borehole during drilling. The pads can help maintain the size of the borehole by a rubbing action when primary cutter elements 40 wear slightly under gage. The gage pads also help stabilize the bit against vibration. In some embodiments, one or more of the gage pads (e.g., gage pads 51) may include cutter elements. Although gage-facing surface 60 of gage pads 51 generally extend to the full bit diameter and the borehole sidewall, in other embodiments, the gage pads may be recessed from the outermost cutting tips of the gage cutter elements, and thus, not extend to the full bit diameter.

Referring to FIG. 4, an exemplary profile of bit 10 is shown as it would appear with all blades (e.g., primary blades 31, 32, secondary blades 33-36) and all primary cutter elements 40 rotated into a single rotated profile. For purposes of clarity, backup cutter elements 50 are not shown in the rotated profile view of FIG. 4.

In rotated profile, the plurality of blades of bit 10 (e.g., primary blades 31, 32 and secondary blades 33-36) include blade profiles 39. Blade profiles 39 and bit face 20 may be divided into three different regions labeled cone region 24, shoulder region 25, and gage region 26. Cone region 24 is concave in this embodiment and comprises the inner most region of bit 10 (e.g., cone region 24 is the central most region of bit 10). Adjacent cone region 24 is shoulder (or the upturned curve) region 25. In this embodiment, shoulder region 25 is generally convex. The transition between cone region 24 and shoulder region 25, typically referred to as the nose or nose region 27, occurs at the axially outermost portion of composite blade profile 39 where a tangent line to the blade profile 39 has a slope of zero. Moving radially outward, adjacent shoulder region 25 is gage region 26, which extends substantially parallel to bit axis 11 at the radially outer periphery of composite blade profile 39. As shown in composite blade profile 39, gage pads 51 define the outer radius 23 of bit 10. In this embodiment, outer radius 23 extends to and therefore defines the full gage diameter of bit 10. As used herein, the term "full gage diameter" refers to the outer diameter of the bit defined by the radially outermost reaches of the cutter elements and surfaces of the bit.

Still referring to FIG. 4, cone region 24 is defined by a radial distance along the x-axis measured from central axis 11. It is to be understood that the x-axis is perpendicular to central axis 11 and extends radially outward from central axis 11. Cone region 24 may be defined by a percentage of outer radius 23 of bit 10. In some embodiments, cone region 24 extends from central axis 11 to no more than 50% of outer radius 23. In select embodiments, cone region 24 extends from central axis 11 to no more than 30% of outer radius 23. Cone region 24 may likewise be defined by the location of one or more secondary blades (e.g., secondary blades 33-36). For example, cone region 24 extends from central axis 11 to a distance at which a secondary blade begins (e.g., distance "D" illustrated in FIG. 3). In other words, the outer boundary of cone region 24 may coincide with the distance "D" at which one or more secondary blades begin. The actual radius of cone region 24, measured from central axis 11, may vary from bit to bit depending on a variety of factors including without limitation, bit geometry, bit type, location of one or more secondary blades (e.g., secondary blades 33-36), location of backup cutter elements 50, or combinations thereof. For instance, in some cases bit 10 may have a relatively flat parabolic profile resulting in a cone region 24 that is relatively large (e.g., 50% of outer radius 23). However, in other cases, bit 10 may have a relatively long parabolic profile resulting in a relatively smaller cone region 24 (e.g., 30% of outer radius 23).

Figure 5:
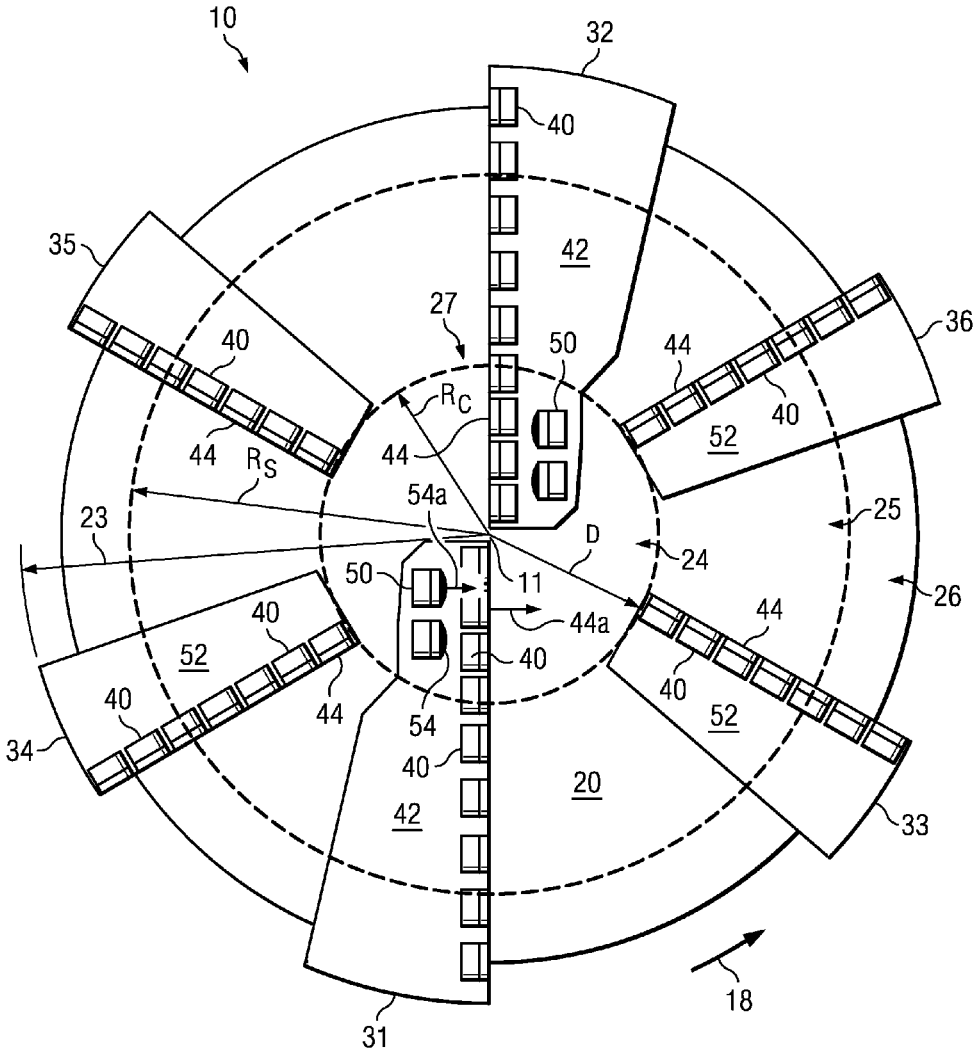
FIG. 5 is a schematic top view of the bit shown in FIG. 2.

Referring now to FIG. 5, a schematic top view of bit 10 is illustrated. For purposes of clarity, nozzles 22 are not shown in this view. Moving radially outward from bit axis 11, bit face 20 includes cone region 24, shoulder region 25, and gage region 26 as previously described. Nose region 27 generally represents the transition between cone region 24 and shoulder region 25. Specifically, cone region 24 extends radially from bit axis 11 to a cone radius $R_c$, shoulder region 25 extends radially from cone radius $R_c$ to shoulder radius $R_s$, and gage region 26 extends radially from shoulder radius $R_s$ to bit outer radius 23.

Primary blades 31, 32 extend radially along bit face 20 from within cone region 24 proximal bit axis 11 toward gage region 26 and outer radius 23. Secondary blades 33-36 extend radially along bit face 20 from proximal nose region 27 toward gage region 26 and outer radius 23. In this embodiment, each secondary blade 33-36 begins at a distance "D" that substantially coincides with the outer radius of cone region 24 (e.g., the intersection of cone region 24 and should region 25). Thus, secondary blades 33-36 do not extend into cone region 24. In other embodiments, the secondary blades (e.g., secondary blades 33-36) may extend to and/or slightly into the cone region (e.g., cone region 24). In this embodiment, each primary blade 31, 32 and each secondary blade 33-36 extends substantially to gage region 26 and outer radius 23. However, in other embodiments, one or more primary and/or secondary blades may not extend completely to the gage region or outer radius of the bit.

Referring still to FIG. 5, each primary blade 31, 32 and each secondary blade 33-36 generally tapers (e.g., becomes thinner) in top view as it extends radially inwards towards central axis 11. Consequently, primary blades 31, 32 are relatively thin proximal axis 11 where space is generally limited circumferentially, and widen towards gage region 26. Although primary blades 31, 32 and secondary blades 33-36 extend linearly in the radial direction in top view, in other embodiments, one or more of the primary blades, one or more secondary blades, or combinations thereof may be arcuate or curve along their length in top view.

Primary blades 31, 32 and secondary blades 33-36 provide cutter-supporting surfaces 42, 52, respectively, for mounting cutter elements 40, 50 as previously described. In this embodiment, nine primary cutter elements 40 arranged in a row are provided on each primary blade 31, 32; seven primary cutter elements 40 arranged in a row are provided on each secondary blade 33-36; and two backup cutter elements 50 arranged in a row are provided on each primary blade 31, 32. In other embodiments, the number of cutter elements (e.g., cutter elements 40) on each primary blade (e.g., primary blades 31, 32) and each secondary blade (e.g., secondary blades 33-36) may vary.

Referring still to FIG. 5, primary cutter elements 40 are provided on each primary blade 31, 32 in regions 24, 25, 26, and primary cutter elements 40 are provided on each secondary blade in regions 25, 26. However, in this embodiment, backup cutter elements 50 are only provided on primary blades 31, 32 (i.e., no backup cutter elements 50 are provided on secondary blades 33-36). Further, backup cutter elements 50 are provided only in cone region 24. Thus, secondary blades 33-36, and regions 25, 26 of primary blades 31, 32 of bit 10 are substantially free of backup cutter elements.

Referring now to FIGS. 2, 3, and 5, each cutter element 40, 50 comprises an elongated and generally cylindrical support member or substrate which is received and secured in a mating pocket formed in the surface of the blade to which it is fixed. In general, each cutter element may have any suitable size and geometry. In this embodiment, each primary cutter element 40 has substantially the same size and geometry, and further, each backup cutter element 50 has substantially the same size and geometry. However, in other embodiments, one or more cutter elements (e.g., cutter element 40) may have a different size and/or geometry.

Figure 7:
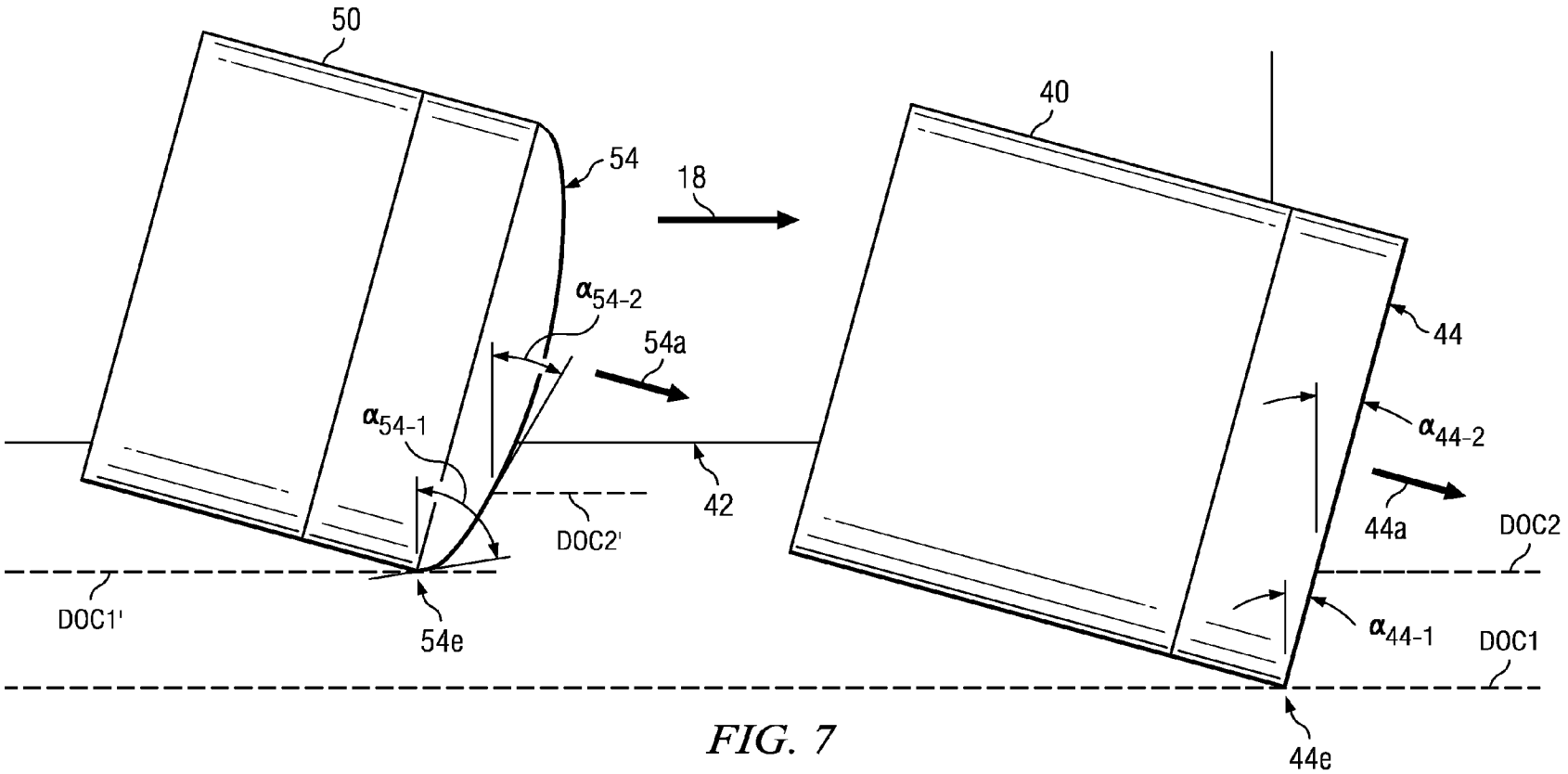
FIG. 7 is a schematic side view of a leading primary cutter element and trailing dome-shaped backup cutter element on the same primary blade of the bit shown in FIG. 2.

Cutting face 44, 54 of each cutter element 40, 50 respectively, comprises a generally disk shaped, hard cutting layer of polycrystalline diamond or other superabrasive material that is bonded to the exposed end of the support member. As best shown in FIG. 7, in this embodiment, each primary cutting face 44 is generally planar, however, each backup cutting face 54 is non-planar or shaped. As used herein, the term "shaped" is used to describe a cutting face that is non-planar. In this embodiment, each backup cutting face 54 is convex or dome-shaped. Examples of cutter elements having convex or dome-shaped cutting faces are described in U.S. Pat. Nos. 4,858,707 and 5,332,051, each of which is hereby incorporated herein by reference in its entirety and is assigned to the assignee of the present application. In general, cutter elements with a convex cutting face (e.g., backup cutter elements 50 with convex cutting face 54) may be referred to herein as "dome" or "dome-shaped" cutters or inserts. In one or more embodiments, dome-shaped cutter elements may have a convex cutting face having a radius of curvature ranging from one half the diameter of the cutting face to three times the diameter of the cutting face, such as from one half the diameter of the cutting face to one times the diameter of the cutting face. For example, a dome-shaped cutter element having a convex cutting face with a diameter of 13 mm may have a radius of curvature ranging from 6.5 mm to 39 mm. In one or more embodiments, the convex cutting face may have a radius of curvature which may be substantially constant.

Referring now to FIGS. 5 and 7, each primary cutter element 40 and each backup cutter element 50 is mounted such that its cutting face 44, 54 is forward facing. In particular, the orientation each cutting face 44, 54 is defined by a surface vector 44*a*, 54*a*, respectively, that extends perpendicularly from the center of cutting face 44, 54, respectively. Thus, as used herein, the phrase "surface vector" refers to a vector that extends perpendicularly from the center of the cutting face. In this embodiment, each surface vector 44*a*, 54*a* extends along or coincides with a projection of the central axis of its corresponding cutter element 40, 50, respectively. Surface vector 44*a*, 54*a* of each cutting face 44, 54, respectively, is oriented at an acute angle relative to the direction of rotation of the bit represented by arrow 18. Thus, as used herein, the phrase "forward facing" describes the orientation of a cutting face that has a surface vector oriented at an acute angle (i.e., less than 90°) relative to the direction of rotation of the bit. Each cutting face 44, 54 includes a cutting edge 44*e*, 54*e*, respectively, distal cutter supporting surface 42, 52, respectively, that positively engages, penetrates, and removes formation material with a shearing action, as opposed to the grinding action utilized by impregnated bits to remove formation material.

Since a "forward facing" cutting face has a surface vector oriented at an acute angle to the direction of rotation of the bit, the surface vector may be parallel or slightly skewed relative to the cutting direction of the bit. Each forward facing cutting face is preferably oriented such that its surface vector is oriented parallel to the direction of rotation of bit 10 plus or minus a 45° in top view (FIG. 5), and more preferably parallel to the direction of rotation of bit 10 plus or minus a 30° in top view. For example, as shown in FIG. 5, surface vector 44*a* of primary cutting face 44 is oriented at an angle relative to the direction of bit rotation represented by arrow 18 that is preferably 0°+/−45°, and more preferably 0°+/−30°. In addition, each forward facing cutting face is preferably oriented such that its surface vector is oriented parallel to the cutter-supporting surface to which it is mounted plus or minus a 45°, and more preferably oriented such that its surface vector is parallel to the cutter-supporting surface to which it is mounted plus or minus a 30°.

Figure 6A:
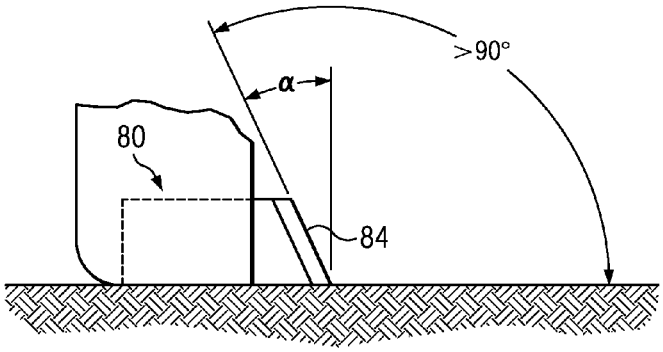
FIGS. 6*a-c* are schematic side views illustrating exemplary cutter elements engaging the formation at various degrees of backrake.
Figure 6B:
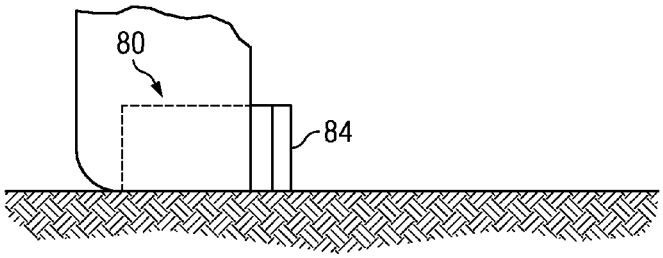
Figure 6C:
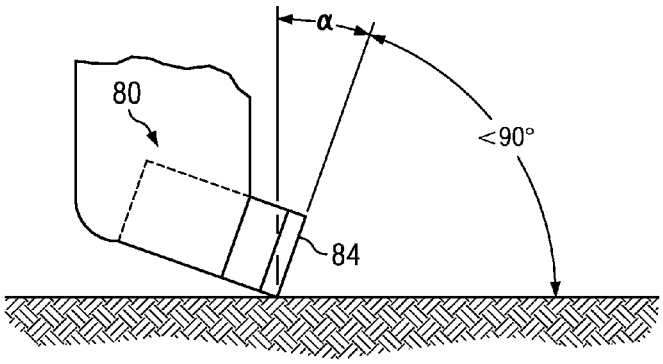

Referring now to FIG. 6*a-c*, the general concept of cutting face backrake angle will be described. In FIGS. 6*a-c*, three exemplary cutter elements 80 having cutting faces 84 mounted on a bit with different backrake angles are shown. The backrake angle of a cutting face may generally be defined as the angle α formed between cutting face 84 of the cutter element 80 and a line that is normal to the formation material being cut. As shown in FIG. 6*b*, where backrake angle α is zero, the cutting face 84 is substantially perpendicular or normal to the formation material. As shown in FIG. 6*a*, where the cutting face 84 engages the formation material at an angle that is greater than 90° measured from the formation material, backrake angle α is positive (i.e., greater than zero). As shown in FIG. 6*c*, where the cutting face 84 engages the formation material at an angle that is less than 90° measured from the formation material, backrake angle α is negative (i.e., less than zero).

For negative backrake angles, the larger the absolute value of the backrake angle the lesser the aggressiveness. For example, a cutter element with a backrake angle α of −30° is less aggressive than a cutter element with a backrake angle α of −10°. For positive backrake angles, the larger the backrake angle the greater the aggressiveness. For example, a cutter element with a backrake angle α of 10° is less aggressive than a cutter element with a backrake angle α of 30°. Thus, moving from positive, to zero, to negative backrake angles (i.e., moving from FIGS. 6*a* to 6*c*), the aggressiveness and cutting loads generally decrease. For example, all other factors being equal, cutter element 84 in FIG. 6*a* experiences greater cutting forces than cutter element 84 in FIG. 6*b*, and cutter element 84 in FIG. 6*b* experiences greater cutting forces than cutter element 84 in FIG. 6*c*.

Referring now to FIG. 7, exemplary primary cutter element 40 and exemplary backup cutter element 50 in cone region 24 of primary blade 31 are schematically shown in side view. Relative to the direction of bit rotation represented by arrow 18, primary cutter element 40 leads backup cutter element 50. As previously described, each primary cutter element 40 has a generally planar cutting face 44. Since each primary cutting face is generally planar, the backrake angle α of any given primary cutting face 44 is constant or fixed regardless of the depth-of-cut of the primary cutting face 44. In other words, regardless of the depth-of-cut of a particular primary cutting face 44, the angle between the primary cutting face 44 and a line that is normal to the formation material being cut is constant. For example, as shown in FIG. 7, at a first depth-of-cut DOC1, exemplary primary cutting face 44 is oriented at a negative backrake angle $\alpha_{44\text{-}1}$, and at a second depth-of-cut DOC2, primary cutting face 44 is oriented at a negative backrake angle $\alpha_{44\text{-}2}$ that is the same as negative backrake angle $\alpha_{44\text{-}1}$. In the embodiment of bit 10 shown and described with reference to FIGS. 2-7, primary cutting faces 44 preferably have a negative backrake angle α between 5° and 45°, and more preferably between 10° and 30°. Although the backrake angle of a given planar cutting face is constant regardless of depth-of-cut, it should be appreciated that two different planar cutting faces may be oriented to have different backrake angles (i.e., one planar cutting face may have a constant backrake angle that is different than the constant backrake angle of the other planar cutting face).

To the contrary each backup cutting face 54 is convex, and thus, provides variable backrake angle depending on the depth-of-cut. For example, as shown in FIG. 7, at a first depth-of-cut DOC1', exemplary backup cutting face 54 is oriented at a negative backrake angle $\alpha_{54\text{-}1}$, and at a second depth-of-cut DOC2', backup cutting face 54 is oriented at a negative backrake angle $\alpha_{54\text{-}2}$ that is less negative (or more positive) than backrake angle $\alpha_{54\text{-}1}$. In general, as the depth-of-cut of backup cutter element 54 increases, its backrake angle increases. As previously described, the more negative the backrake angle, the less aggressive the cutting face. Thus, the aggressiveness of convex backup cutting face 54 increases as its depth-of-cut increases. Upon initial engagement with the formation, convex backup cutting face 54 has a relatively large negative backrake angle, and thus, is very unaggressive (nonaggressive), however, as the depth-of-cut of convex backup cutting face 54 increases, it becomes more aggressive. Each convex backup cutting face 54 preferably has a negative backrake angle between about 10° and 80°, and more preferably between about 20° and 60°.

Referring still to FIG. 7, each cutting face 44, 54 includes a cutting edge 44*e*, 54*e*, respectively, adapted to positively engage, penetrate, and remove formation material with a shearing action, as opposed to the grinding action utilized by impregnated bits to remove formation material. As previously described, the aggressiveness of convex backup cutting face 54 increases as its depth-of-cut increases. As each convex backup cutting face 54 has a relatively large negative backrake angle (e.g., backrake angle $\alpha_{54\text{-}1}$) at its periphery, cutting edge 54*e* and convex backup cutting face 54 is relatively unaggressive upon initial engagement with the formation. Consequently, as convex backup cutting face 54 first engages the formation, its ability to shear the formation and associated rate of penetration is limited. However, as the depth-of-cut of convex backup cutting face 54 increases, it becomes more aggressive, and its ability to shear the formation, and hence, its rate of penetration, increases.

In this embodiment, primary cutting faces 44 are not beveled or chamfered. However, in other embodiments, one or more primary cutting face (e.g., primary cutting face 44) may be chamfered or beveled as desired. Such a chamfer or bevel offers the potential to reduce the aggressiveness of a cutting face upon initial engagement with the formation and to reduce the likelihood of chipping and/or breakage of the cutting face.

In the embodiment illustrated in FIGS. 2-5, each primary cutter element 40 has substantially the same size and geometry as other primary cutter elements 40. Further, each backup cutter element 50 has substantially the same size and geometry as other backup cutter elements 50. However, in general, each primary cutter element 40 and each backup cutter element 50 may have any suitable size and geometry.

Figure 8:
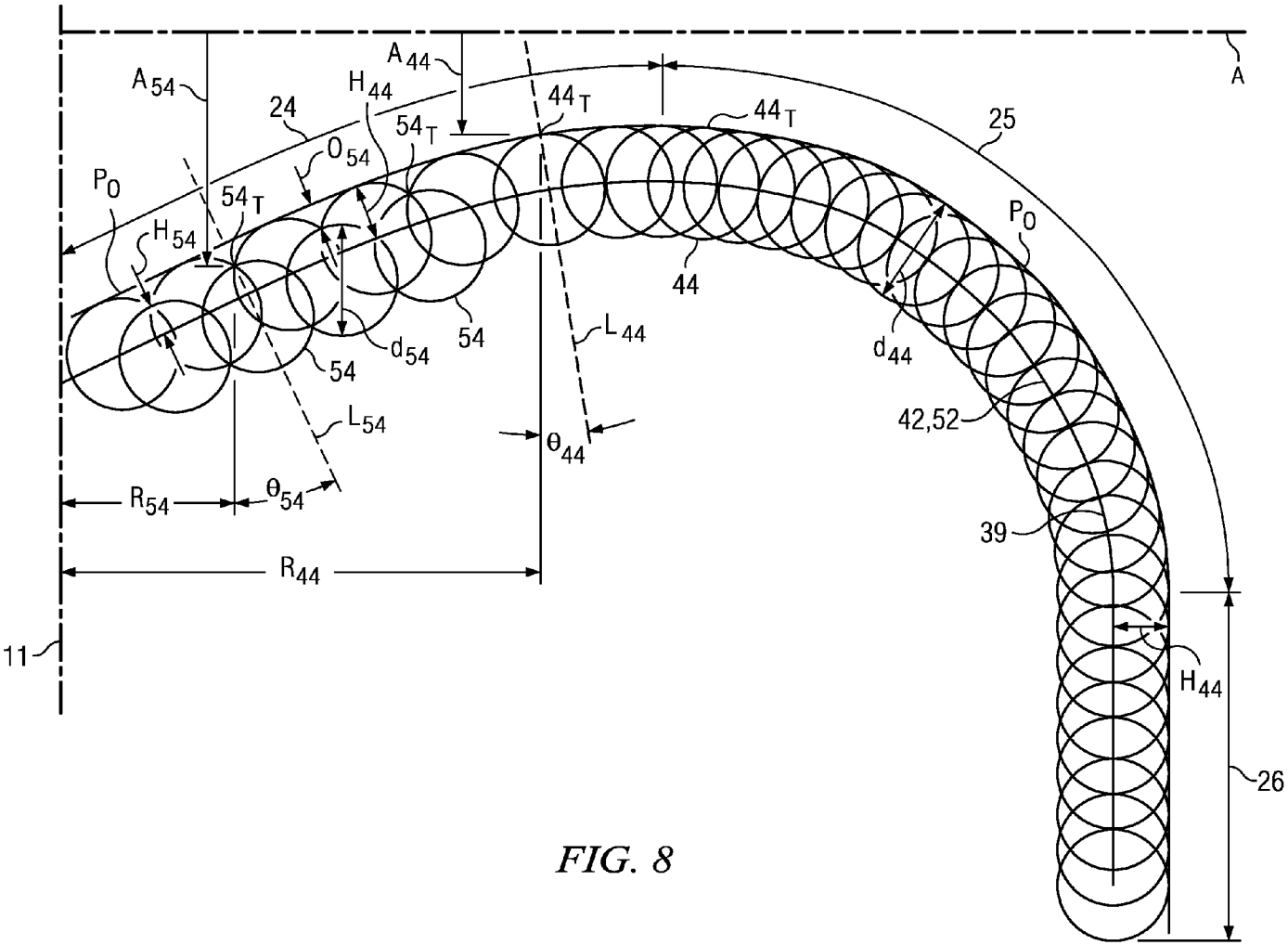
FIG. 8 is an enlarged view of the composite rotated profile of FIG. 4.

Referring now to FIG. 8, the profiles of primary blades 31, 32, secondary blades 33-36, and cutting faces 44, 54 are schematically shown rotated into a single composite rotated profile view. In rotated profile view, each primary blade 31, 32 and each secondary blade 33-36 forms a blade profile generally defined by its cutter-supporting surface 42, 52. In this embodiment, the profiles of each primary blade 31, 32 and each secondary blade 33-36 are each generally coincident with each other, thereby forming a single composite blade profile 39 previously described with reference to FIG. 4.

Referring still to FIG. 8, in this embodiment, each primary cutting face 44 extends to substantially the same extension height $H_{44}$ measured perpendicularly from cutter-supporting surface 42, 52 (or blade profile 39), and each backup cutting face 54 (i.e., each cutting face 31-54, 32-54) extends to substantially the same extension height $H_{54}$ measured perpendicularly from its corresponding cutter-supporting surface 42, 52 (or blade profile 39). As used herein, the phrase "extension height" refers to the distance or height to which a structure (e.g., cutting face) extends perpendicularly from the cutter-supporting surface (e.g., cutter-supporting surface 42, 52) of the blade to which it is mounted. In this embodiment, extension height $H_{54}$ is less than extension height $H_{44}$.

Cutting tips $\mathbf{44}_T$ at extension height $H_{44}$ define an outermost cutting profile $P_o$ that extends radially from bit axis 11 to outer radius 23 (not shown). In this embodiment, outermost cutting profile $P_o$ is generally parallel to blade profile 39. In general, the outermost cutting profile (e.g., outermost cutting profile $P_o$) is defined by a curve passing through each cutting tip (e.g., cutting tip $44_T$) that is not eclipsed or covered by another cutting face (e.g., cutting face 44, 54) in rotated profile view. Thus, as used herein, the phrase "outermost cutting profile" refers to the curve or profile passing through each cutting tip that is not eclipsed or covered by the cutting face of another cutter element in rotated profile view. The outermost cutting profile does not pass through the cutting tips that are eclipsed or covered by another cutting face in rotated profile view. As shown in FIG. 8, no cutting tip $44_T$ is eclipsed or covered by another cutting face 44, 54 in rotated profile view, however, each cutting tip $54_T$ is covered or eclipsed by a primary cutting face 44 in rotated profile view. Thus, outermost cutting profile $P_o$ passes through each cutting tip $44_T$, but does not pass through any of cutting tips $54_T$.

Backup cutting faces 54 do not extend to outermost cutting profile $P_o$, and thus, may be described as being offset or "off profile" relative to outermost cutting profile $P_o$. As used herein, the phrase "off profile" refers to a structure (e.g., cutter element) extending from the cutter-supporting surface of a blade (e.g., cutter supporting surface 42, 52) that does not extend to the outermost cutting profile (e.g., outermost cutting profile $P_o$) in rotated profile view, whereas, the phrase "on profile" refers to structure that extends from the cutter-supporting surface to the outermost cutting profile in rotated profile view. The degree to which an off-profile structure is offset from the outermost cutting profile may be described in terms of a "cutting profile offset distance" equal to the minimum or shortest distance between the structure and the outermost cutting profile in rotated profile view. In this embodiment, each backup cutting face 54 is offset from outermost cutting profile $P_o$ by a cutting profile offset distance $O_{54}$ equal to difference between extension height $H_{44}$ and extension height $H_{54}$. Cutting profile offset distance $O_{54}$ is preferably between 0.010 in. (~0.254 mm) and 0.100 in. (~2.54 mm), and more preferably between 0.020 in. (~0.508 mm) and 0.070 in. (~1.778 mm). Although backup cutting faces 54 are off-profile in this embodiment, in other embodiments, one or more of the backup cutting faces (e.g., backup cutting faces 54) may be on-profile.

Referring still to FIG. 8, in this embodiment, each primary cutter element 40 and primary cutting face 44 has substantially the same size and geometry, and each backup cutter element 50 and backup cutting face 54 has substantially the same size and geometry. In particular, each primary cutting face 44 has a diameter $d_{44}$, and each backup cutting face 54 has a diameter $d_{54}$. In this embodiment, diameter $d_{54}$ is substantially the same as diameter $d_{44}$. However, in other embodiments, one or more primary cutting face (e.g., primary cutting face 44) and/or one or more backup cutting face (e.g., backup cutting face 54) may have a different diameter. For an exemplary bit 10 having an overall gage diameter of 7.875 in. (~20 cm), diameter d of each cutting face 44, 54 may be about 0.625 in. (~16 mm).

As a result of the relative sizes and radial positions cutting faces 44, 54, each primary cutting face 44 is eclipsed by one or more adjacent cutting faces 44, 54 in rotated profile view. However, no primary cutting face 44 is completely eclipsed. For example, cutting tips $44_T$ are not eclipsed or covered by any other cutting face 44, 54.

Referring still to FIG. 8, the concepts of axial position, radial position, profile angle line, and profile angle will be described with reference to the composite rotated profile of bit 10. For purposes of this disclosure, the "axial position" of a cutting face is defined by the axial distance measured perpendicularly from a reference plane "A" that is perpendicular to the bit axis to the cutting tip of the cutting face. As previously described, each cutting face 44, 54 has an outermost cutting tip $44_T$, $54_T$, respectively, disposed at extension height $H_{44}$, $H_{54}$, respectively. Thus, the axial position of each cutting face 44, 54 is defined by the axial distance measured parallel to bit axis 11 (perpendicularly from reference plane A) to its cutting tip $44_T$, $54_T$, respectively. For example, as shown in FIG. 8, the axial position of exemplary primary cutting face 44 is defined by an axial distance $A_{44}$ measured perpendicularly from reference plane A (measured parallel to bit axis 11) to cutting tip $44_T$ of cutting face 44. As another example, the axial position of backup cutting face 54 is defined by a axial distance $A_{54}$ measured perpendicularly from reference plane A to cutting tip $54_T$ of backup cutting face 54.

For purposes of this disclosure, the "radial position" of a cutting face is defined by the radial distance measured perpendicularly from the bit axis to the cutting tip of the cutting face. As previously described, each cutting face 44, 54 has an outermost cutting tip $44_T$, $54_T$, respectively, disposed at extension height $H_{44}$, $H_{54}$, respectively. Thus, the radial position of each cutting face 44, 54 is defined by the radial distance measured perpendicularly from bit axis 11 to its cutting tip $44_T$, $54_T$, respectively. For example, as shown in FIG. 8, the radial position of exemplary primary cutting face 44 is defined by a radial distance $R_{44}$ measured perpendicularly from bit axis 11 to cutting tip $44_T$ of cutting face 44. As another example, the radial position of backup cutting face 54 is defined by a radial distance $R_{54}$ measured perpendicularly from bit axis 11 to cutting tip $54_T$ of backup cutting face 54.

As best shown in FIG. 8, each cutter element 40, 50 and its associated cutting face 44, 54, respectively, is disposed at a different and unique radial and/or axial position in rotated profile view. In cone and shoulder regions 24, 25, each cutter element 40, 50 and its associated cutting face 44, 54 is disposed at a different and unique radial position relative to bit axis 11 in rotated profile view. However, in gage region 26, multiple cutter elements 40 and their associated cutting faces 44 may be disposed at similar radial positions. In cone and shoulder regions 24, 25, one or more pair of cutter elements 40, 50 and their associated cutting faces 44, 54 may be disposed at the same axial position relative to reference plane A in rotated profile view. However, in gage region 26, each cutter element 40 and its associated cutting face 44 is disposed at a different and unique axial position. Thus, no two cutter elements 40, 50 or cutting faces 44, 54 are disposed at the same radial position relative to bit axis 11 and axial position relative to reference plane A.

Although cutting faces 44, 54 are each disposed at a different and unique radial position and/or axial position, due to their relative sizes and positions, cutting faces 44 at least partially overlap with one or more other cutting faces 44 in rotated profile view. In other words, each cutting face 44 is eclipsed by at least one other cutting face 44 in rotated profile view. In this manner, cutting faces 44 are positioned and arranged to enhance bottomhole coverage. In other embodiments, one or more cutting face (e.g., cutting face 44, 54) may be disposed at the same radial position in cone region 24 and/or shoulder region 25.

As shown in FIGS. 5 and 8, in this embodiment, each backup cutting face 54 is radially disposed between a pair of primary cutting faces 44 on the same primary blade 31, 32. Each cutting face 44, 54 cuts a kerf in the formation. A ridge of uncut formation is formed between each pair of radially adjacent cutting faces 44, 54 on the same blade. Since each backup cutting face 54 is radially disposed between two primary cutting faces 44 on the same primary blade 31, 32, backup cutting faces 54 engage the ridge formed between that pair of primary cutting faces 44.

Referring still to FIG. 8, the orientation of each cutting face (e.g., cutting face 44, 54) may also be described in terms of a "profile angle line" that bisects the cutting face in rotated profile view, and a "profile angle." The profile angle line of a cutting face bisects the cutting face (e.g., cutting face 44, 54) and is perpendicular to the outermost cutting profile (e.g., outermost cutting profile $P_o$) in rotated profile view. Thus, as used herein, the "profile angle line" of a cutting face refers to a line that bisects the cutting face and is perpendicular to outermost cutting profile in rotated profile view. For example, a profile angle line $L_{44}$ is perpendicular to outermost cutting profile $P_o$ and bisects exemplary primary cutting face 44 in rotated profile view. As another example, a profile angle line $L_{54}$ is perpendicular to outermost cutting profile $P_o$ and bisects exemplary backup cutting face 54 in rotated profile view.

The profile angle line of each cutting face (e.g., cutting face 44, 54) is oriented at a profile angle θ measured between the bit axis (or a line parallel to the bit axis) and the profile angle line in rotated profile view. Thus, as used herein, the phrase "profile angle" refers to the angle between a profile angle line and a line parallel to the bit axis in rotated profile view. For example, profile angle line $L_{44}$ of exemplary primary cutting face 44 is oriented at a profile angle $\theta_{44}$ and profile angle line $L_{54}$ of exemplary backup cutting face 54 is oriented at a profile angle $\theta_{54}$. As best shown in FIG. 8, each cutting face 44, 54 is disposed at a unique profile angle in cone and shoulder regions 24, 25.

As compared to other bits that include only conventional cutter elements with planar faces in the cone region, embodiments of bit 10 offer the potential for controlled aggressiveness in cone region 24 without significant reductions in ROP. Specifically, as compared to conventional planar cutting faces, backup cutter elements 50 in cone region 24 with convex cutting faces 54 provide variable backrake angles and aggressiveness. As previously described, upon initial engagement with the formation, convex backup cutting face 54 has a relatively large negative backrake angle, and thus, is very unaggressive. However, as the depth-of-cut of convex backup cutting faces 54 increase, their backrake angle and aggressiveness also increases. Such attributes in the cone region (e.g., cone region 24) may be particularly suited to directional drilling. Namely, when frictional engagement between the drillstring and borehole sidewall are overcome during weight stacking procedures, the drill bit will abruptly engage the borehole bottom. As compared to conventional planar cutting faces (e.g., primary cutting faces 44), convex cutting faces 54 have relatively large negative backrake angles upon initial engagement with the formation. Consequently, convex cutting faces 54 are less aggressive, and experience reduced depths-of-cut and cutting loads as compared to conventional planar cutting faces. Such reduced depths-of-cut and cutting loads upon abrupt engagement with the borehole bottom offers the potential to reduce the likelihood of downhole motor stall.

Although convex cutting faces 54 have a large negative backrake angle and are relatively unaggressive upon initial engagement with the formation, as their depth-of-cut increases, their aggressiveness and backrake angle increase, approaching that of conventional planar cutting faces. Consequently, convex cutting faces 54 provide reduced aggressiveness upon initial engagement with the formation (e.g., abrupt engagement with the borehole bottom), thereby reducing the likelihood of downhole motor stall, but also provide more conventional aggressiveness as their depth-of-cut increases, and thus, do not substantially decrease bit ROP.

Figure 9:
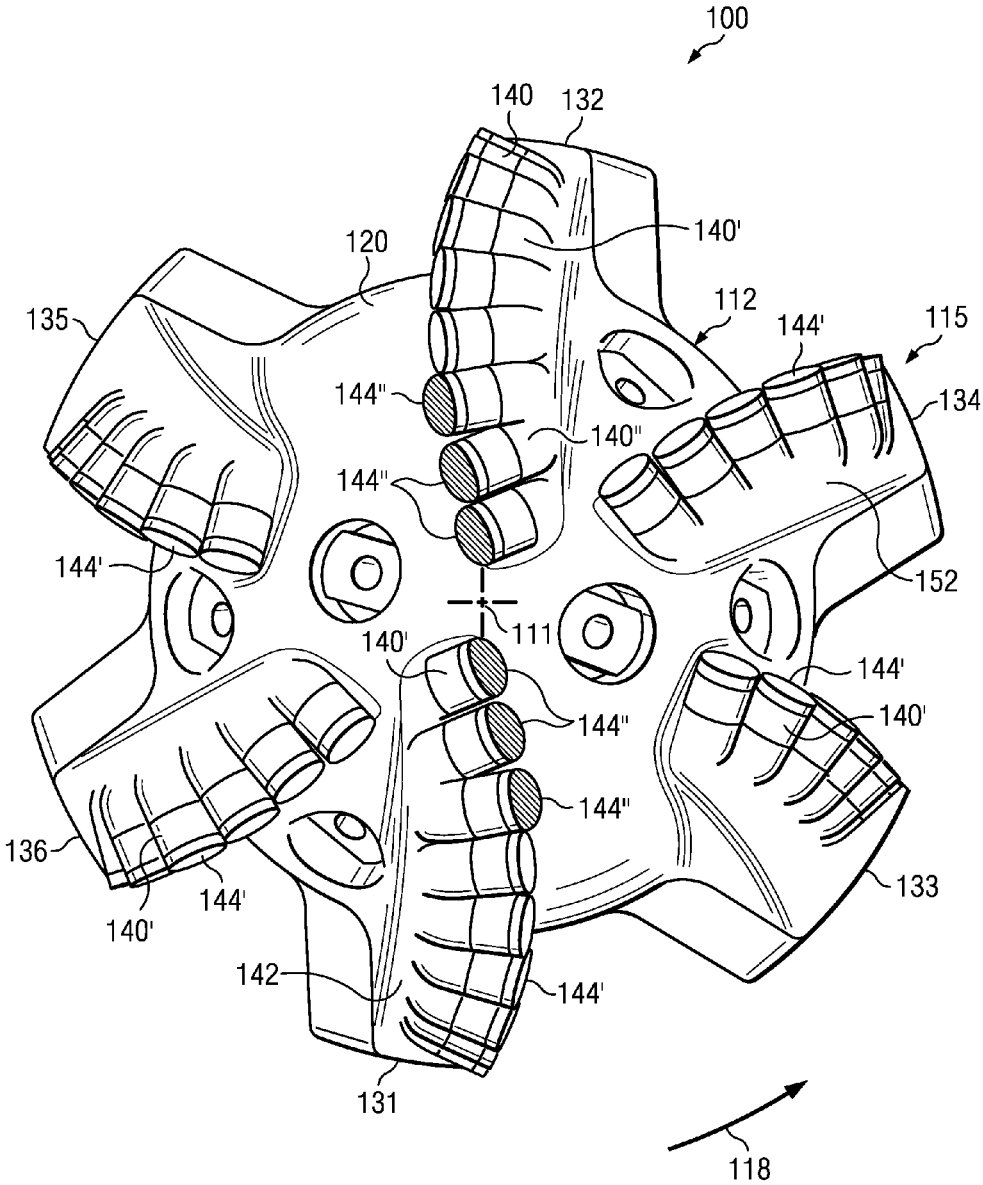
FIG. 9 is a top view of another embodiment of a bit made in accordance with the principles described herein.
Figure 10:
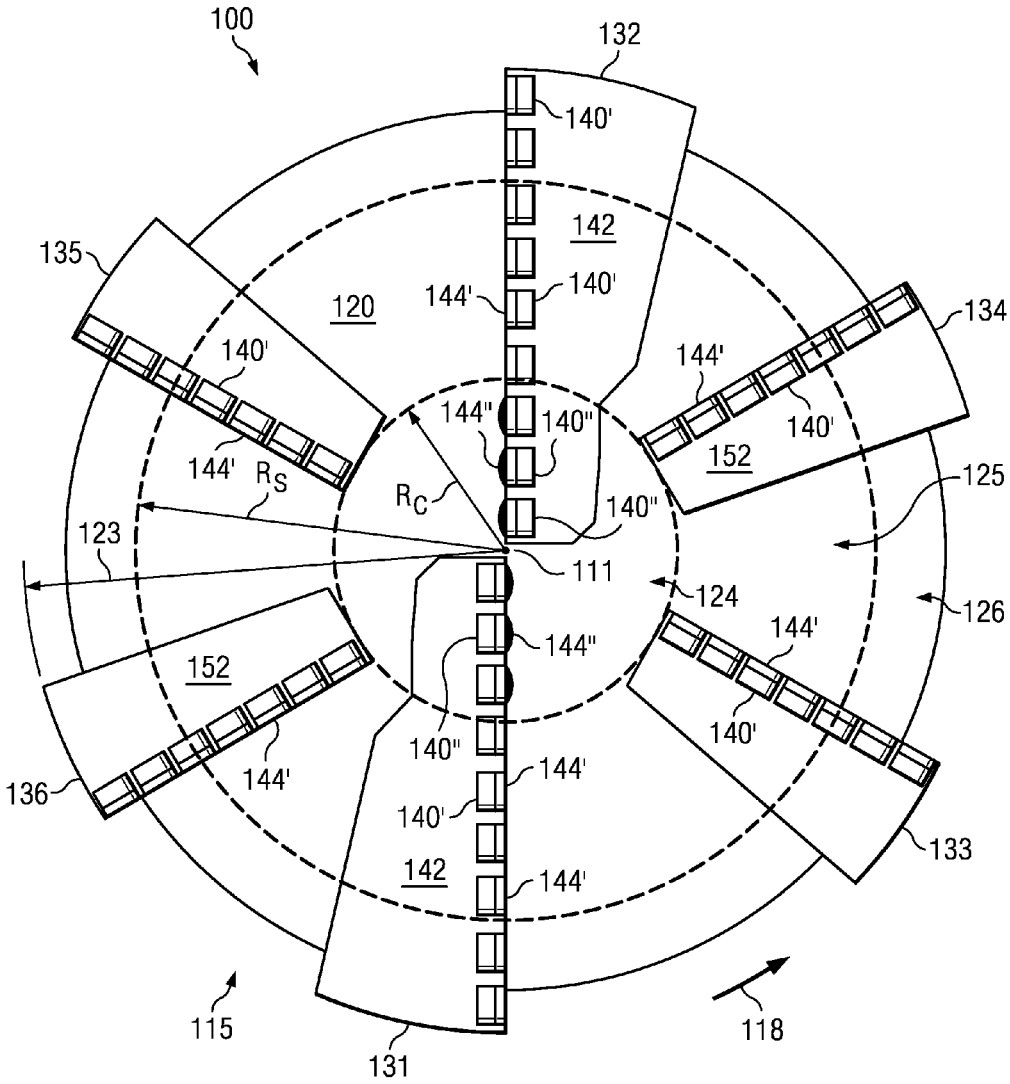
FIG. 10 is a schematic top view of the bit shown in FIG. 9.

Referring now to FIGS. 9 and 10, another embodiment of a fixed cutter bit 100 adapted for drilling through formations of rock to form a borehole is shown. Bit 100 is similar to bit 10 previously described. Namely, bit 100 includes a bit body 112 and a bit face 120 that supports a cutting structure 115. Bit 100 further includes a central axis 111 about which bit 100 rotates in the cutting direction represented by arrow 118.

As best shown in FIG. 10, moving radially outward from bit axis 111, bit face 120 includes a radially inner cone region 124, a radially intermediate shoulder region 125, and a radially outer gage region 126 similar to region 24, 25, 26, respectively, previously described. Cone region 124 extends radially from bit axis 111 to a cone radius $R_c$, shoulder region 125 extends radially from cone radius $R_c$ to shoulder radius $R_s$, and gage region 126 extends radially from shoulder radius $R_s$ to bit outer radius 123. Similar to regions 24, 25, 26, previously described, in this embodiment, cone region 124 is concave, shoulder region 125 is generally convex, and gage region 126 extends substantially parallel to bit axis 111.

Cutting structure 115 includes two primary blades 131, 132 circumferentially spaced-apart about bit axis 111, and four secondary blades 133-136 circumferentially spaced-apart about bit axis 111. In this embodiment, blades 131-136 are uniformly angularly spaced on bit face 120 about bit axis 111. Each primary blade 131, 132 includes a cutter-supporting surface 142 for mounting a plurality of cutter elements, and each secondary blade 133-136 also includes a cutter-supporting surface 152 for mounting a plurality of cutter elements.

Referring still to FIGS. 9 and 10, a plurality of primary cutter elements 140 are mounted to cutter supporting surface 142, 152 of each primary blade 131, 132 and each secondary blade 133-136, respectively. Primary cutter elements 140 are positioned adjacent one another generally in a row extending radially along each blade 131-136. Primary cutter elements 140 include cutter elements 140' having generally planar cutting faces 144' and shaped cutter elements 140" having convex cutting faces 144". Thus, unlike bit 10 previously described which only included primary cutter elements 40 with planar primary cutting faces 44, in this embodiment, primary cutting faces 144" of select primary cutter elements 140 are convex. Dome-shaped cutter elements 140" are disposed adjacent one another on each primary blade 131, 132 in cone region 124, and cutter elements 140' are disposed adjacent one another on each primary blade 131, 132 and each secondary blade 133-136 in shoulder region 125 and gage region 126. In this embodiment, each cutting face 144', 144" is forward-facing relative to the direction of bit rotation represented by arrow 118.

Each planar cutting face 144' and each convex cutting face 144" is oriented at a negative backrake angle. As each primary cutting face 144' is generally planar, the backrake angle α each primary cutting face 144' is constant or fixed. In this embodiment, primary cutting faces 144' preferably have a negative backrake angle α between 5° and 45°, and more preferably between 10° and 30°. However, as cutting faces 144" are convex, their effective backrake angle varies with depth-of-cut. In particular, the aggressiveness of each convex cutting face 144" increases as its depth-of-cut increases. Upon initial engagement with the formation, each convex cutting face 144" has a relatively large negative backrake angle, and thus, is very unaggressive, however, as the depth-of-cut of convex cutting face 144" increases, it becomes more aggressive. Each convex cutting face 144" preferably has a negative backrake angle between about 10° and 80°, and more preferably between about 20° and 60°.

Although cutting faces 144' are shown and described as generally planar, cutting faces 144' may include a bevel or chamfer. Such a chamfer or bevel offers the potential to reduce the aggressiveness of a cutting face upon initial engagement with the formation and to reduce the likelihood of chipping and/or breakage of the cutting face.

In the embodiment, each primary cutter element 140' has substantially the same size and geometry, and each primary cutter element 140" has substantially the same size and geometry. Primary cutter elements 140" are sized similarly to primary cutter elements 140', however, primary cutter elements 140" include convex cutting faces 144", whereas primary cutter elements 140' include generally planar cutting faces 144'.

Figure 11:
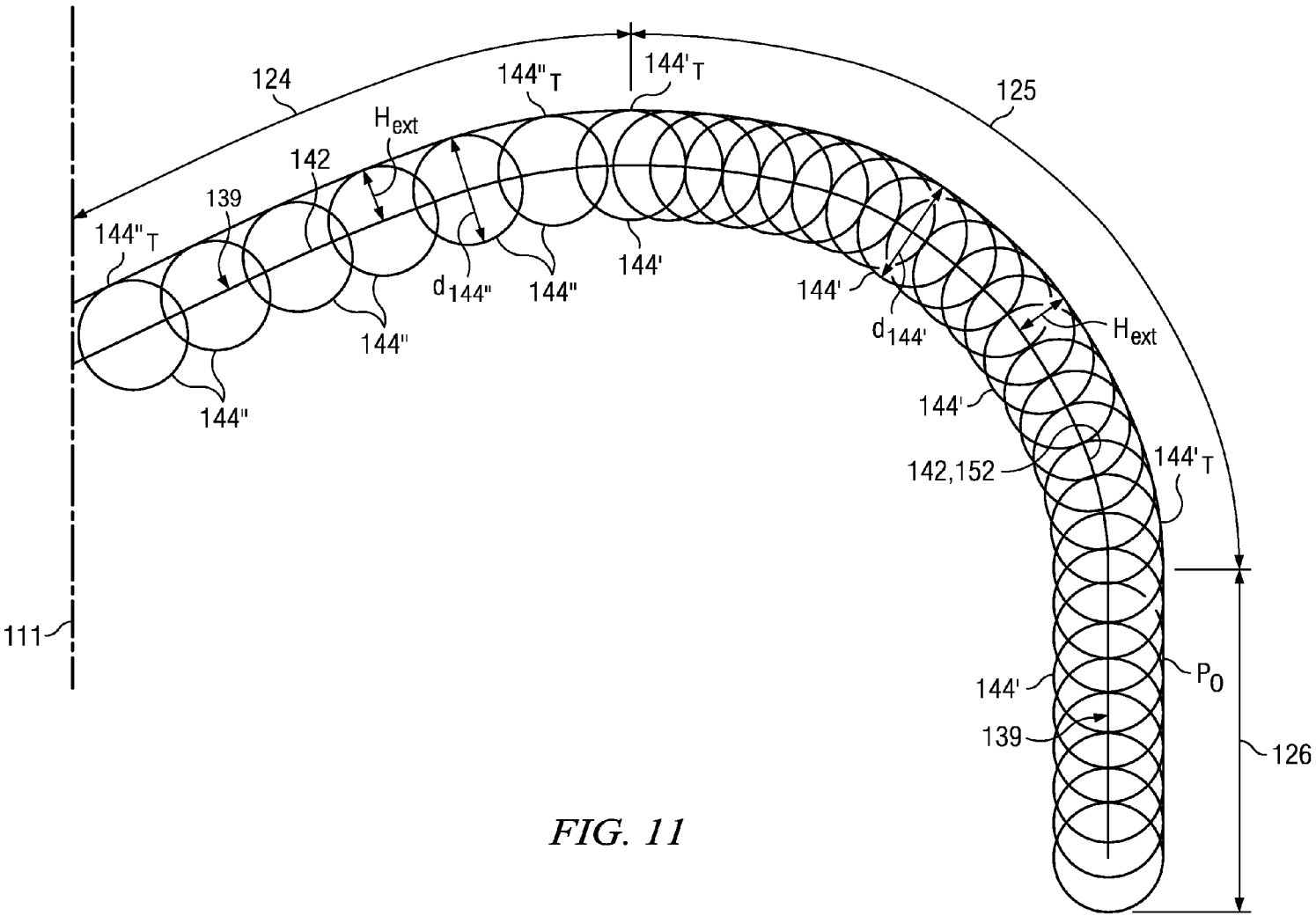
FIG. 11 is a composite rotated profile view of the bit shown in FIG. 9.

Referring now to FIG. 11, the profiles of primary blades 131, 132, secondary blades 133-136, and cutting faces 144', 144" are schematically shown rotated into a single composite rotated profile view. In rotated profile view, each primary blade 131, 132 and each secondary blade 133-136 forms a blade profile generally defined by its cutter-supporting surface 142, 152. In this embodiment, the profiles of each primary blade 131, 132 and each secondary blade 133-136 are each generally coincident with each other, thereby forming a single composite blade profile 139.

Referring still to FIG. 11, in this embodiment, each primary cutting face 144', 144" extends to substantially the same extension height $H_{ext}$ measured perpendicularly from cutter-supporting surface 142, 152 (or blade profile 139). None of cutting tips 144'$_T$, 144"$_T$ of cutting faces 144', 144", respectively, is eclipsed or covered by another cutting face 144', 144". Thus, cutting tips 144'$_T$, 144"$_T$ each extend to and define an outermost cutting profile $P_o$ that extends radially from bit axis 111 to outer radius 123 (not shown). In this embodiment, outermost cutting profile $P_o$ is generally parallel to blade profile 139. In this embodiment, each cutting face 144', 144" is on-profile. In other words, neither planar cutting faces 144' nor convex cutting faces 144" are offset from the outermost cutting profile $P_o$. In other embodiments, one or more convex cutting face (e.g., convex cutting face 144") and/or one or more planar cutting face (e.g., planar cutting face 144') may be offset from the outermost cutting profile (e.g., outermost cutting profile $P_o$).

Referring still to FIG. 11, in this embodiment, each planar cutting face 144' has substantially the same size and geometry, and each convex cutting face 144" has substantially the same size and geometry. In particular, each planar cutting face 144' has a diameter $d_{144'}$, and each convex cutting face 144" has a diameter $d_{144''}$. In this embodiment, diameter $d_{144'}$ is substantially the same as diameter $d_{144''}$. As a result of the relative sizes and radial positions of cutting faces 144', 144", each cutting face 144', 144" is substantially eclipsed by one or more adjacent cutting faces 144', 144" in rotated profile view. However, no cutting face 144', 144" is completely eclipsed.

As best shown in FIG. 11, each cutter element 140', 140" and its associated cutting face 144', 144", respectively, is disposed at a different and unique radial position and/or axial position. In cone and shoulder regions 124, 125, each cutter element 140', 140" and its associated cutting face 144', 144", respectively, is disposed at a different and unique radial position relative to bit axis 111 in rotated profile view. In addition, each cutting face 144', 144" is disposed at a unique profile angle in cone and shoulder regions 124, 125. Although cutting faces 144', 144" in regions 124, 125 are each disposed in different radial positions, due to their relative sizes and positions, cutting faces 144', 144" at least partially overlap with one or more other cutting faces 144', 144" in rotated profile view. In this manner, cutting faces 144', 144" are positioned and arranged to enhance bottomhole coverage.

As compared to other bits that include only conventional cutter elements with planar faces in the cone region, embodiments of bit 100 offer the potential for controlled aggressiveness in cone region 124 without significant reductions in ROP. Specifically, as compared to conventional planar cutting faces, dome-shaped cutter elements 140" in cone region 124 with convex cutting faces 144" provide variable backrake angles and aggressiveness—upon initial engagement with the formation, each convex cutting face 144" has a relatively large negative backrake angle, and thus, is very unaggressive. However, as the depth-of-cut of convex cutting faces 144" increase, their backrake angle and aggressiveness also increases. For the same reason described above for bit 10, such attributes in the cone region (e.g., cone region 124) may be particularly suited to directional drilling.

Figure 12:
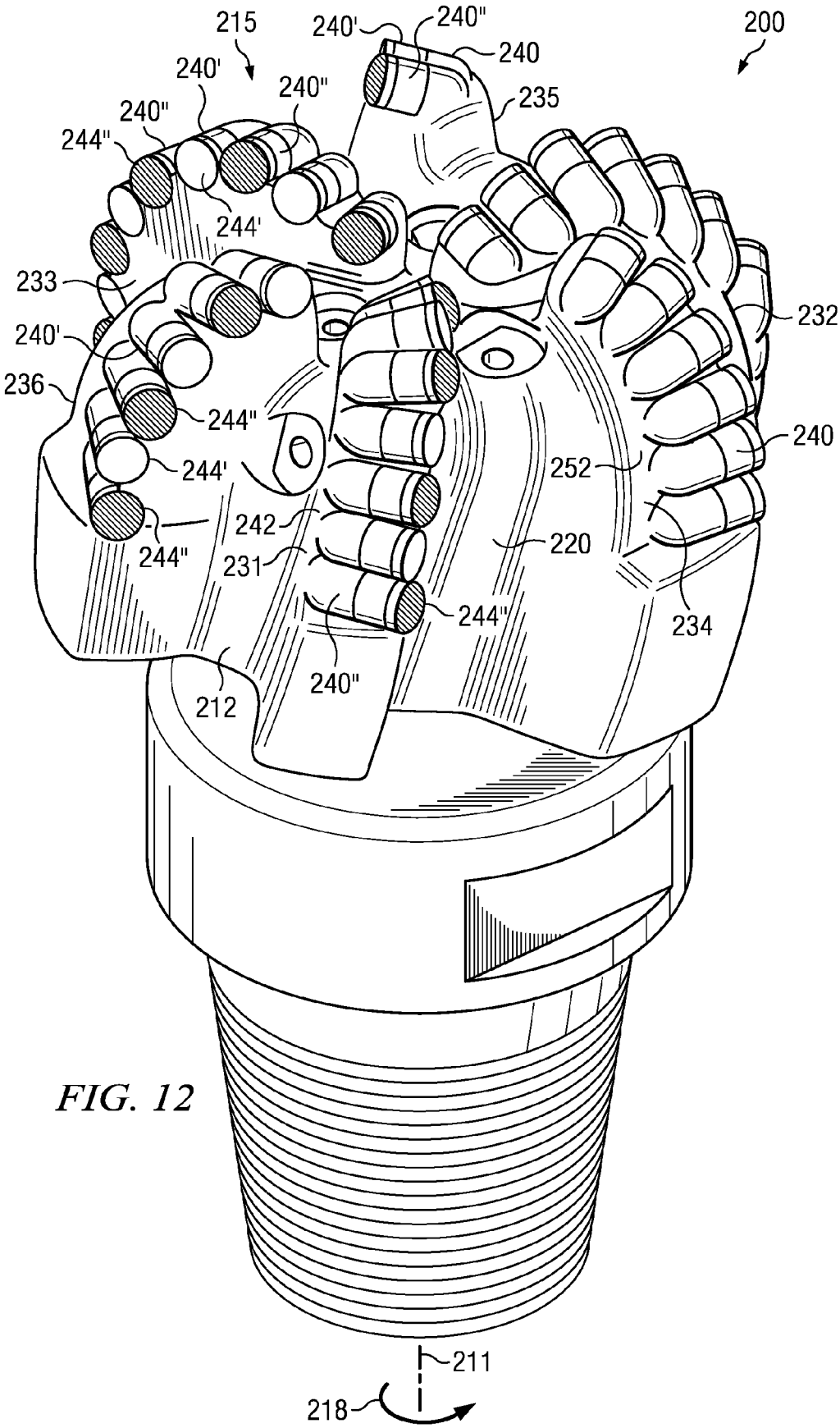
FIG. 12 is a perspective view of another embodiment of a bit made in accordance with the principles described herein.
Figure 13:
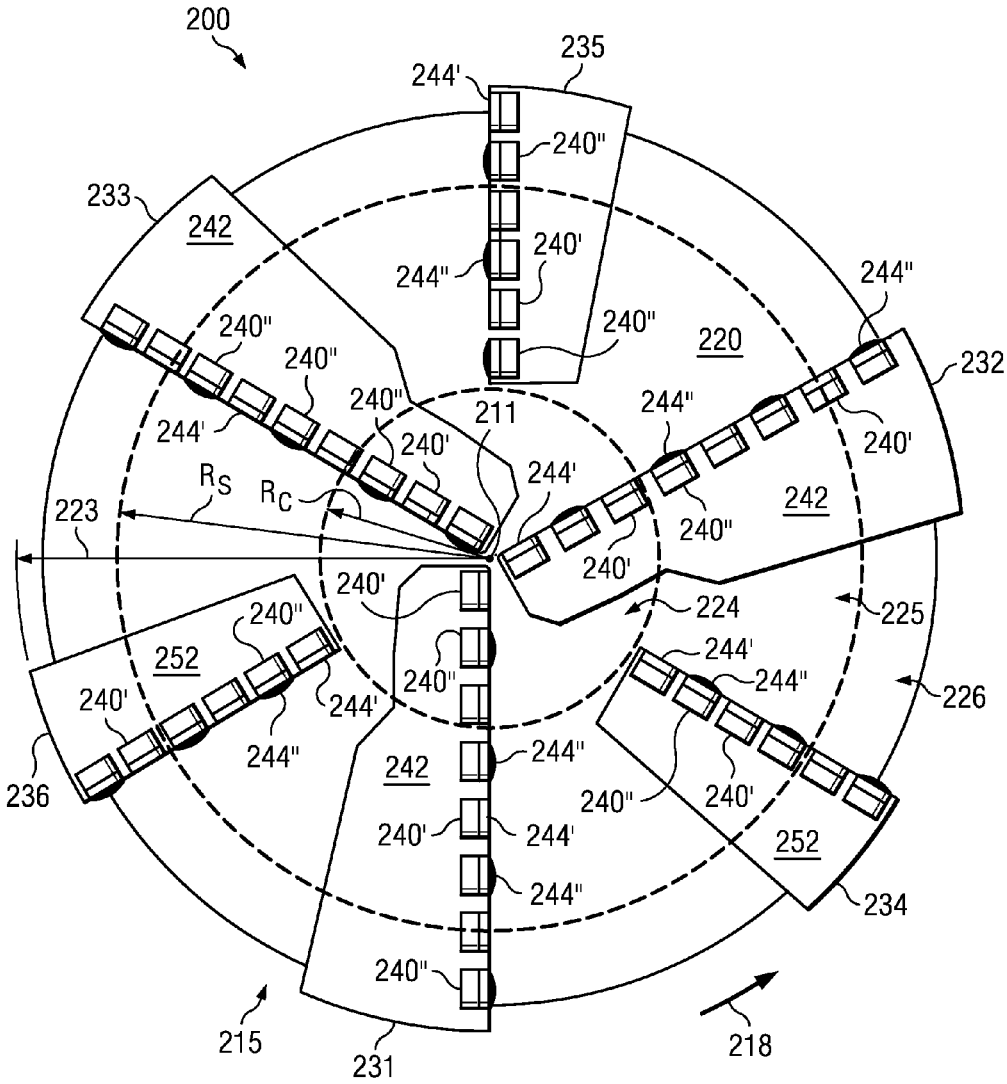
FIG. 13 is a schematic top view of the bit shown in FIG. 12.

Referring now to FIGS. 12 and 13, another embodiment of a fixed cutter bit 200 adapted for drilling through formations of rock to form a borehole is shown. Bit 200 is similar to bits 10, 100 previously described. Namely, bit 200 includes a bit body 212 and a bit face 220 that supports a cutting structure 215. Bit 200 further includes a central axis 211 about which bit 200 rotates in the cutting direction represented by arrow 218.

As best shown in FIG. 13, moving radially outward from bit axis 211, bit face 220 includes a radially inner cone region 224, a radially intermediate shoulder region 225, and a radially outer gage region 226 similar to region 24, 25, 26, respectively, previously described. Cone region 224 extends radially from bit axis 211 to a cone radius $R_c$, shoulder region 225 extends radially from cone radius $R_c$ to shoulder radius $R_s$, and gage region 226 extends radially from shoulder radius $R_s$ to bit outer radius 223. In this embodiment, cone region 224 is concave, shoulder region 225 is generally convex, and gage region 226 extends substantially parallel to bit axis 211.

Cutting structure 215 includes three primary blades 231, 232, 233 circumferentially spaced-apart about bit axis 211, and three secondary blades 234, 235, 236 circumferentially spaced-apart about bit axis 211. In this embodiment, blades 231-236 are uniformly angularly spaced on bit face 220 about bit axis 211. Each primary blade 231-233 includes a cutter-supporting surface 242 for mounting a plurality of cutter elements, and each secondary blade 234-236 also includes a cutter-supporting surface 252 for mounting a plurality of cutter elements.

Referring still to FIGS. 12 and 13, a plurality of primary cutter elements 240 are mounted to cutter supporting surface 242, 252 of each primary blade 231-233 and each secondary blade 236-236, respectively. Primary cutter elements 240 are positioned adjacent one another generally in a row extending radially along each blade 231-236. Primary cutter elements 240 include cutter elements 240' having generally planar cutting faces 244' and shaped cutter elements 240" having convex cutting faces 244". Thus, unlike bit 10 previously described which only included primary cutter elements 40 with planar primary cutting faces 44, in this embodiment, primary cutting faces 244" of select primary cutter elements 240 are convex. Further, unlike bits 10, 100 previously described, in this embodiment, dome-shaped cutter elements 240" with convex cutting faces 244" are disposed in cone region 224, shoulder region 225, and gage region 226. In particular, each row of primary cutter elements 240 on each blade 231-236 includes an alternating pattern of cutter elements 240' and dome-shaped cutter elements 240". In other words, moving radially outward on each blade 231-236, each cutter element 240' is followed by a dome-shaped cutter element 240", which is followed by another cutter element 240', and so on. As best shown in FIG. 13, moving radially outward, the row of primary cutter elements 240 on each blade 231, 232, 234, 236 begins with one of cutter elements 240', whereas the row of primary cutter elements 240 on each blade 233, 235 begins with one of dome-shaped cutter elements 240". In this embodiment, each cutting face 244', 244" is forward-facing relative to the direction of bit rotation represented by arrow 218.

Each planar cutting face 244' and each convex cutting face 244" is oriented at a negative backrake angle. As each primary cutting face 244' is generally planar, the backrake angle $\alpha$ each primary cutting face 244' is constant or fixed. In this embodiment, primary cutting faces 244' preferably have a negative backrake angle $\alpha$ between 5° and 45°, and more preferably between 10° and 30°. However, as cutting faces 244" are convex, their effective backrake angle varies with depth-of-cut. In particular, the aggressiveness of each convex cutting face 244" increases as its depth-of-cut increases. Upon initial engagement with the formation, each convex cutting face 244" has a relatively large negative backrake angle, and thus, is very unaggressive, however, as the depth-of-cut of convex cutting face 244" increases, it becomes more aggressive. Each convex backup cutting face 244" preferably has a negative backrake angle between about 10° and 80°, and more preferably between about 20° and 60°.

In the embodiment, each primary cutter element 240' has substantially the same size and geometry, and each primary cutter element 240" has substantially the same size and geometry. Primary cutter elements 240" are sized similarly to primary cutter elements 240', however, primary cutter elements 240" include convex cutting faces 244", whereas primary cutter elements 240' include generally planar cutting faces 244'.

Figure 14:
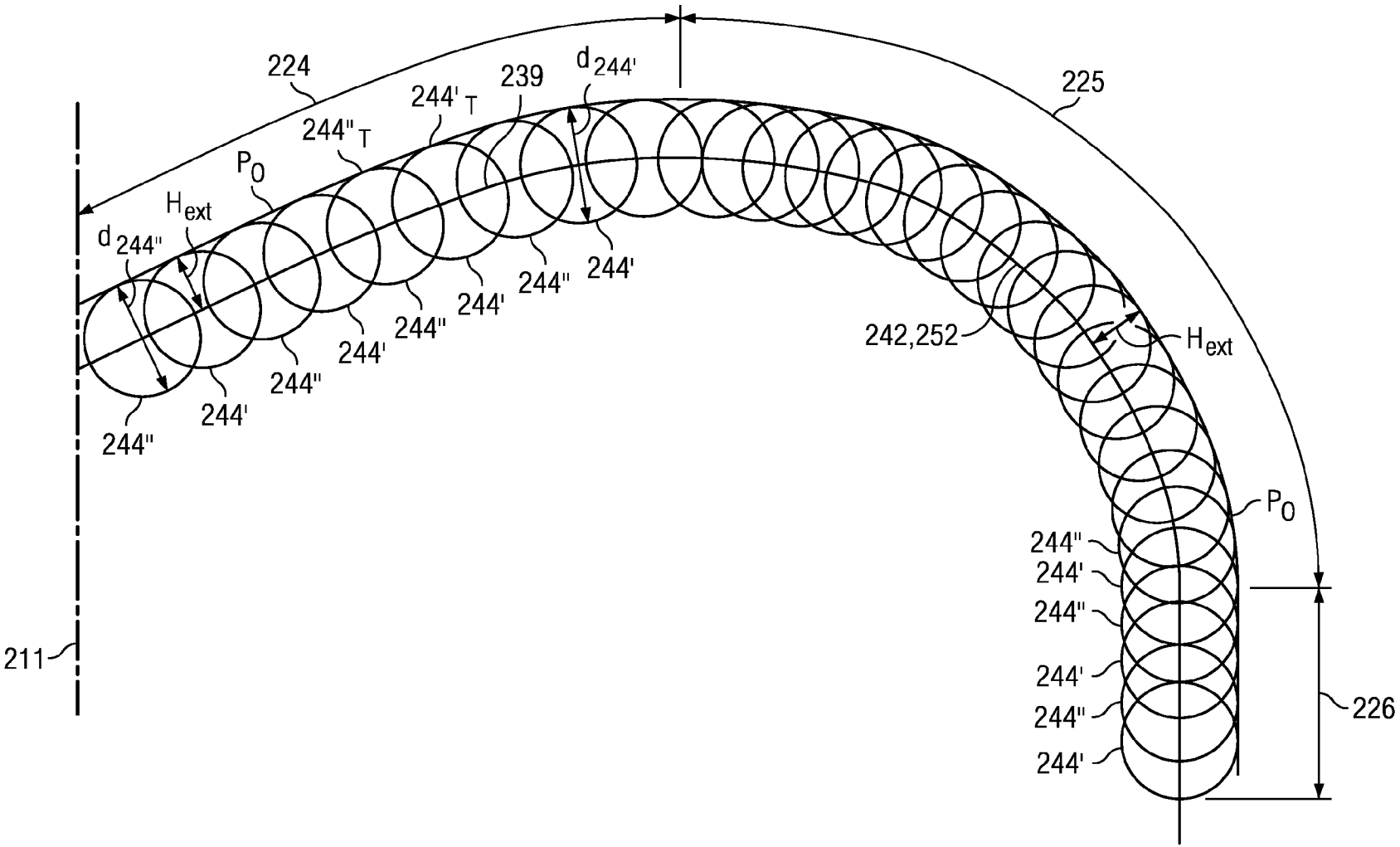
FIG. 14 is a composite rotated profile view of the bit shown in FIG. 12.

Referring now to FIG. 14, the profiles of primary blades 231-233, secondary blades 234-236, and cutting faces 244', 244" are schematically shown rotated into a single composite rotated profile view. In rotated profile view, each primary blade 231-233 and each secondary blade 234-236 forms a blade profile generally defined by its cutter-supporting surface 242, 252. In this embodiment, the profiles of each primary blade 231-233 and each secondary blade 234-236 are each generally coincident with each other, thereby forming a single composite blade profile 239.

Referring still to FIG. 14, in this embodiment, each primary cutting face 244', 244" extends to substantially the same extension height $H_{ext}$ measured perpendicularly from cutter-supporting surface 242, 252 (or blade profile 239). None of cutting tips cutting tips $\mathbf{244'}_T$, $\mathbf{244"}_T$ of cutting faces 244', 244", respectively, is eclipsed or covered by another cutting face 244', 244". Thus, cutting tips $\mathbf{244'}_T$, $\mathbf{244"}_T$ each extend to and define an outermost cutting profile $P_o$ that extends radially from bit axis 211 to outer radius 223 (not shown). In this embodiment, outermost cutting profile $P_o$ is generally parallel to blade profile 239. In this embodiment, each cutting face 244', 244" is on-profile. In other words, neither planar cutting faces 244' nor convex cutting faces 244" are offset from the outermost cutting profile $P_o$. In other embodiments, one or more convex cutting face (e.g., convex cutting face 244") and/or one or more planar cutting face (e.g., planar cutting face 244') may be offset from the outermost cutting profile (e.g., outermost cutting profile $P_o$).

Referring still to FIG. 14, in this embodiment, each planar cutting face 244' has substantially the same size and geometry, and each convex cutting face 244" has substantially the same size and geometry. In particular, each planar cutting face 244' has a diameter $d_{244'}$, and each convex cutting face 244" has a diameter $d_{244"}$. In this embodiment, diameter $d_{244'}$ is substantially the same as diameter $d_{244"}$. As a result of the relative sizes and radial positions of cutting faces 244', 244", each cutting face 244', 244" is substantially eclipsed by one or more adjacent cutting faces 244', 244" in rotated profile view. However, no cutting face 244', 244" is completely eclipsed.

As best shown in FIG. 14, each cutter element 240', 240" and its associated cutting face 244', 244", respectively, is disposed at a different and unique radial position and/or axial position. In cone and shoulder regions 224, 225, each cutter element 240', 240" and its associated cutting face 244', 244", respectively, is disposed at a different and unique radial position relative to bit axis 211 in rotated profile view. In addition, each cutting face 244', 244" is disposed at a unique profile angle in cone and shoulder regions 224, 225. Although cutting faces 244', 244" in regions 224, 225 are each disposed in different radial positions, due to their relative sizes and positions, cutting faces 244', 244" at least partially overlap with one or more other cutting faces 244', 244" in rotated profile view. In this manner, cutting faces 244', 244" are positioned and arranged to enhance bottomhole coverage.

As compared to other bits that include only conventional cutter elements with planar faces, embodiments of bit 200 offer the potential for controlled aggressiveness along the entire bit profile in cone region 224, shoulder region 225, and gage region 226 without significant reductions in ROP. Specifically, as compared to conventional planar cutting faces, dome-shaped cutter elements 240" in regions 224, 225, 226 with convex cutting faces 244" provide variable backrake angles and aggressiveness—upon initial engagement with the formation, each convex cutting face 244" has a relatively large negative backrake angle, and thus, is very unaggressive. However, as the depth-of-cut of convex cutting faces 244" increase, their backrake angle and aggressiveness also increases. Such attributes in the gage region (e.g., gage region 226) offer the potential to reduce lateral deviation of the bit (e.g., bit 200) during drilling. In particular, as compared to conventional planar cutting faces (e.g., primary cutting faces 244'), convex cutting faces 244" have relatively large negative backrake angles upon initial engagement with the formation. Consequently, convex cutting faces 244" in gage region 226 are less aggressive, and hence, provide reduced depths-of-cut upon initial engagement with the formation. Such reduced depths-of-cut upon initial engagement with the borehole sidewall (such as from lateral movement or vibration of the bit) offers the potential to reduce the likelihood and magnitude of borehole sidewall cutting and associated lateral deviation. In addition, reduced and controlled depths-of-cut offer the potential to reduce bit vibrations and cutter element damage when drilling across transitional formations.

Although convex cutting faces 244" have a large negative backrake angle and are relatively unaggressive upon initial engagement with the formation, as their depth-of-cut increases, their aggressiveness and backrake angle increase, approaching that of conventional planar cutting faces. Consequently, convex cutting faces 244" provide reduced aggressiveness upon initial engagement with the formation (such as when bit 200 moves or vibrates laterally), thereby reducing the likelihood of undesirable borehole sidewall cutting and associated lateral deviation, but also provide more conventional aggressiveness as their depth-of-cut increases and comparable ROP in instances where sidewall cutting is intentionally facilitated.

Figure 15:
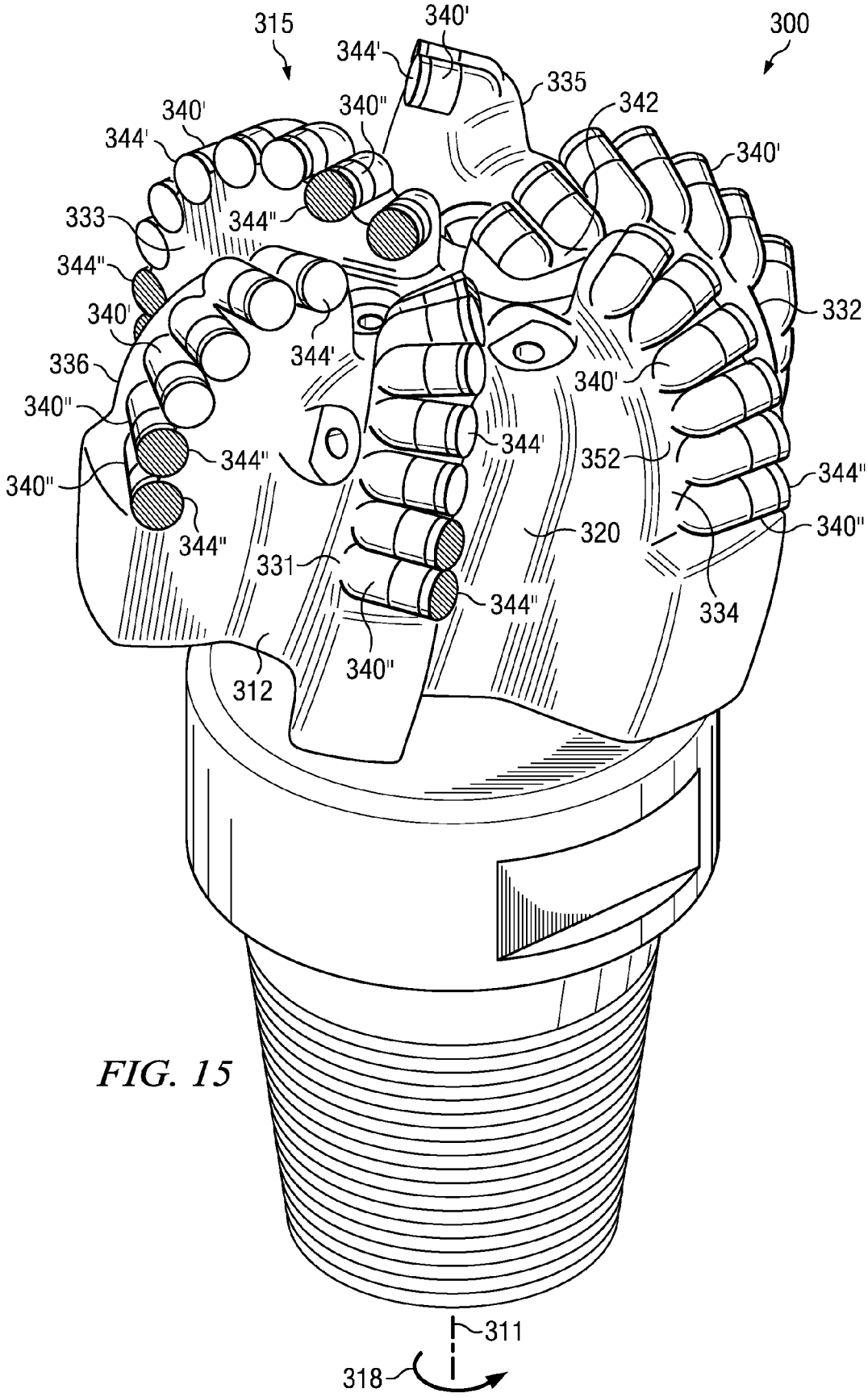
FIG. 15 is a perspective view of another embodiment of a bit made in accordance with the principles described herein.
Figure 16:
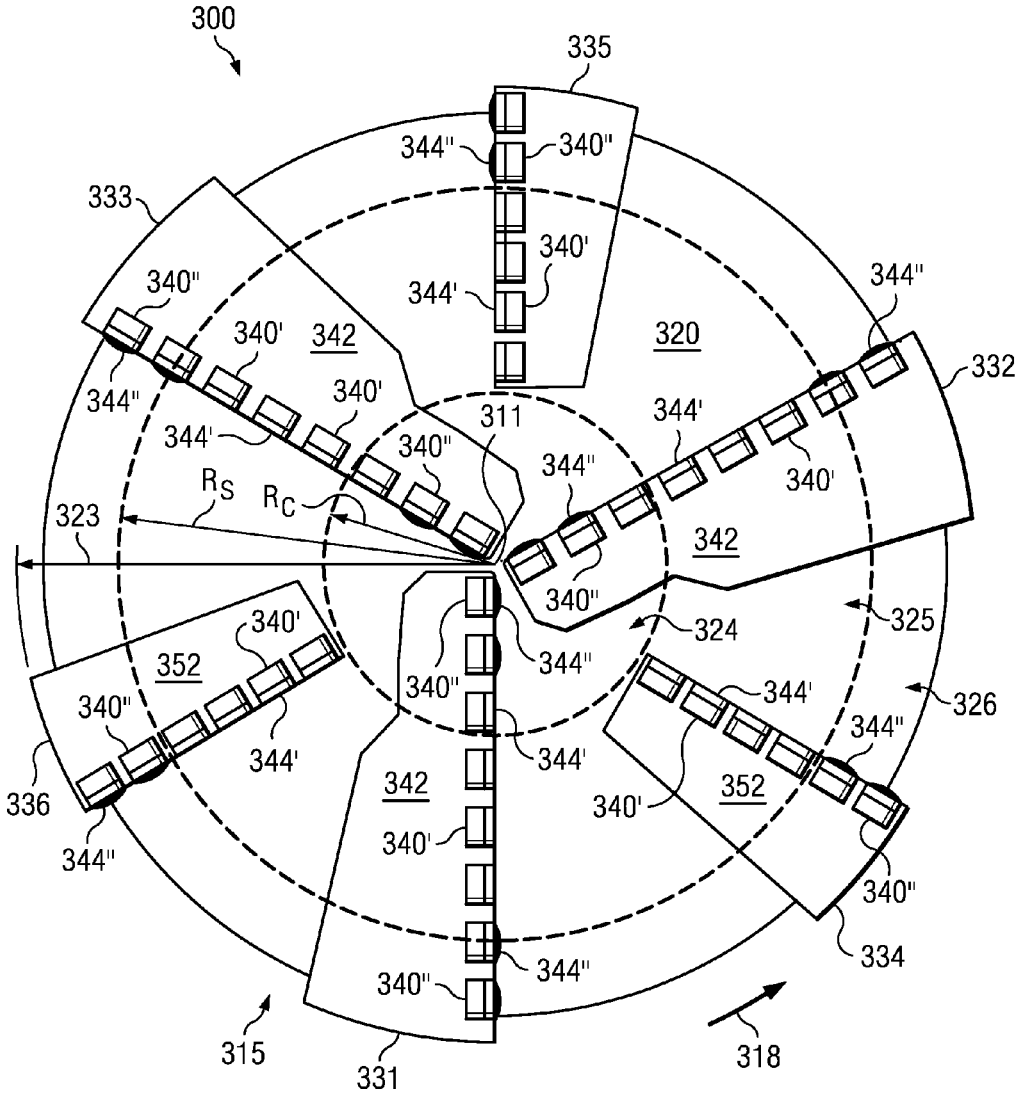
FIG. 16 is a schematic top view of the bit shown in FIG. 15.

Referring now to FIGS. 15 and 16, another embodiment of a fixed cutter bit 300 adapted for drilling through formations of rock to form a borehole is shown. Bit 300 is similar to bits 10, 100, 200 previously described. Namely, bit 300 includes a bit body 312 and a bit face 320 that supports a cutting structure 315. Bit 300 further includes a central axis 311 about which bit 300 rotates in the cutting direction represented by arrow 318.

As best shown in FIG. 16, moving radially outward from bit axis 311, bit face 320 includes a radially inner cone region 324, a radially intermediate shoulder region 325, and a radially outer gage region 326 similar to region 24, 25, 26, respectively, previously described. Cone region 324 extends radially from bit axis 311 to a cone radius $R_c$, shoulder region 325 extends radially from cone radius $R_c$ to shoulder radius $R_s$, and gage region 326 extends radially from shoulder radius $R_s$ to bit outer radius 323. In this embodiment, cone region 324 is concave, shoulder region 325 is generally convex, and gage region 326 extends substantially parallel to bit axis 311.

Cutting structure 315 includes three primary blades 331, 332, 333 circumferentially spaced-apart about bit axis 311, and three secondary blades 334, 335, 336 circumferentially spaced-apart about bit axis 311. In this embodiment, blades 331-336 are uniformly angularly spaced on bit face 320 about bit axis 311. Each primary blade 331-333 includes a cutter-supporting surface 342 for mounting a plurality of cutter elements, and each secondary blade 334-336 also includes a cutter-supporting surface 352 for mounting a plurality of cutter elements.

Referring still to FIGS. 15 and 16, a plurality of primary cutter elements 340 are mounted to cutter supporting surface 342, 352 of each primary blade 331-333 and each secondary blade 336-336, respectively. Primary cutter elements 340 are positioned adjacent one another generally in a row extending radially along each blade 331-336. Primary cutter elements 340 include cutter elements 340' having generally planar cutting faces 344' and shaped cutter elements 340" having convex cutting faces 344". Thus, unlike bit 10 previously described which only included primary cutter elements 40 with planar primary cutting faces 44, in this embodiment, primary cutting faces 344" of select primary cutter elements 340 are convex. Further, unlike bits 10, 100 previously described, in this embodiment, dome-shaped cutter elements 340" with convex cutting faces 344" are disposed in both cone region 324 and gage region 326. In particular, each primary blade 331-333 includes two dome-shaped cutter elements 340" adjacent each other in cone region 324 and two dome-shaped cutter elements 340" adjacent each other in gage region 326. Further, each secondary blade 334-336 includes two dome-shaped cutter elements 340" in gage region 326. Dome-shaped cutter elements 340" are the two radially inner most cutter elements 340 on each primary blade 331-333 and the two radially outermost cutter elements 340 on each blade 331-336. Cutter elements 340' extend along each blade 331-336 in shoulder region 325. In this embodiment, each cutting face 344', 344" is forward-facing relative to the direction of bit rotation represented by arrow 318.

Each planar cutting face 344' and each convex cutting face 344" is oriented at a negative backrake angle. As each primary cutting face 344' is generally planar, the backrake angle $\alpha$ each primary cutting face 344' is constant or fixed. In this embodiment, primary cutting faces 344' preferably have a negative backrake angle $\alpha$ between 5° and 45°, and more preferably between 10° and 30°. However, as cutting faces 344" are convex, their effective backrake angle varies with depth-of-cut. In particular, the aggressiveness of each convex cutting face 344" increases as its depth-of-cut increases. Upon initial engagement with the formation, each convex cutting face 344" has a relatively large negative backrake angle, and thus, is very unaggressive, however, as the depth-of-cut of convex cutting face 344" increases, it becomes more aggressive. Each convex cutting face 344" preferably has a negative backrake angle between about 10° and 80°, and more preferably between about 20° and 60°.

In the embodiment, each primary cutter element 340' has substantially the same size and geometry, and each primary cutter element 340" has substantially the same size and geometry. Primary cutter elements 340" are sized similarly to primary cutter elements 340', however, primary cutter elements 340" include convex cutting faces 344", whereas primary cutter elements 340' include generally planar cutting faces 344'.

Figure 17:
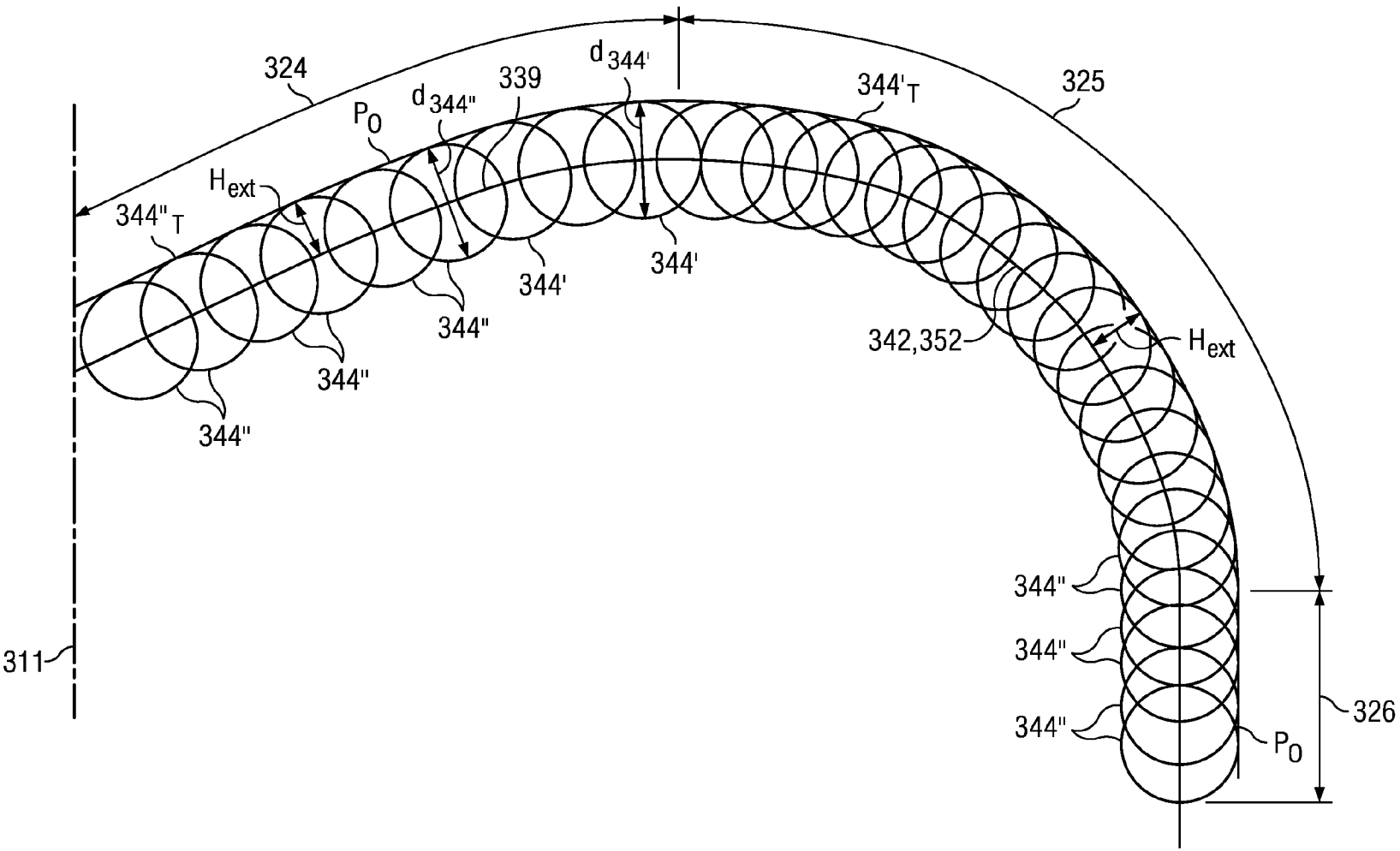
FIG. 17 is a composite rotated profile view of the bit shown in FIG. 15.

Referring now to FIG. 17, the profiles of primary blades 331-333, secondary blades 334-336, and cutting faces 344', 344" are schematically shown rotated into a single composite rotated profile view. In rotated profile view, each primary blade 331-333 and each secondary blade 334-336 forms a blade profile generally defined by its cutter-supporting surface 342, 352. In this embodiment, the profiles of each primary blade 331-333 and each secondary blade 334-336 are each generally coincident with each other, thereby forming a single composite blade profile 339.

In this embodiment, each primary cutting face 344', 344" extends to substantially the same extension height $H_{ext}$ measured perpendicularly from cutter-supporting surface 342, 352 (or blade profile 339). None of cutting tips cutting tips $\mathbf{344'}_T$, $\mathbf{344"}_T$ of cutting faces 344', 344", respectively, is eclipsed or covered by another cutting face 344', 344". Thus, cutting tips $\mathbf{344'}_T$, $\mathbf{344"}_T$ each extend to and define an outermost cutting profile $P_o$ that extends radially from bit axis 311 to outer radius 323 (not shown). In this embodiment, outermost cutting profile $P_o$ is generally parallel to blade profile 339. In this embodiment, each cutting face 344', 344" is on-profile. In other words, neither planar cutting faces 344' nor convex cutting faces 344" are offset from the outermost cutting profile $P_o$.

Referring still to FIG. 17, in this embodiment, each planar cutting face 344' has substantially the same size and geometry, and each convex cutting face 344" has substantially the same size and geometry. In particular, each planar cutting face 344' has a diameter $d_{344'}$, and each convex cutting face 344" has a diameter $d_{344''}$. In this embodiment, diameter $d_{344'}$ is substantially the same as diameter $d_{344''}$. As a result of the relative sizes and radial positions of cutting faces 344', 344", each cutting face 344', 344" is substantially eclipsed by one or more adjacent cutting faces 344', 344" in rotated profile view. However, no cutting face 344', 344" is completely eclipsed.

In cone and shoulder regions 324, 325, each cutter element 340', 340" and its associated cutting face 344', 344", respectively, is disposed at a different and unique radial position relative to bit axis 311 in rotated profile view. In addition, each cutting face 344', 344" is disposed at a unique profile angle in cone and shoulder regions 324, 325. Although cutting faces 344', 344" in regions 324, 325 are each disposed in different radial positions, due to their relative sizes and positions, cutting faces 344', 344" at least partially overlap with one or more other cutting faces 344', 344" in rotated profile view. In this manner, cutting faces 344', 344" are positioned and arranged to enhance bottomhole coverage.

As compared to other bits that include only conventional cutter elements with planar faces, embodiments of bit 300 offer the potential for controlled aggressiveness in both cone region 324 and gage region 326 without significant reductions in ROP. Specifically, as compared to conventional planar cutting faces, dome-shaped cutter elements 340" in regions 324, 326 with convex cutting faces 344" provide variable backrake angles and aggressiveness—upon initial engagement with the formation, each convex cutting face 344" has a relatively large negative backrake angle, and thus, is very unaggressive. However, as the depth-of-cut of convex cutting faces 344" increase, their backrake angle and aggressiveness also increases. As previously described, such attributes in the cone region (e.g., cone region 324) offer the potential to reduce the likelihood of downhole motor stall following weight stacking procedures in directional drilling applications. In addition, as previously described, such attributes in the gage region (e.g., gage region 326) offer the potential to reduce the likelihood of bit deviation resulting from sidecutting during lateral movements and/or vibrations of the bit.

Although convex cutting faces 344" have a large negative backrake angle and are relatively unaggressive upon initial engagement with the formation, as their depth-of-cut increases, their aggressiveness and backrake angle increase, approaching that of conventional planar cutting faces. Consequently, convex cutting faces 344" provide reduced aggressiveness upon initial engagement with the formation (such as when bit 300 moves or vibrates laterally or abruptly engages the borehole bottom following weight stacking procedures), but also provide more conventional aggressiveness as their depth-of-cut increases and comparable ROP in instances where borehole sidewall cutting and/or bottomhole cutting is intentionally facilitated.

While specific embodiments have been shown and described, modifications thereof can be made by one skilled in the art without departing from the scope or teaching herein. The embodiments described herein are exemplary only and are not limiting. For example, embodiments described herein may be applied to any bit layout including, without limitation, single set bit designs where each cutter element has unique radial and/or axial position along the rotated cutting profile, plural set bit designs where cutter elements may have a redundant cutter element in the same radial position provided on a different blade when viewed in rotated profile, forward spiral bit designs, reverse spiral bit designs, or combinations thereof. In addition, embodiments described herein may also be applied to straight blade configurations or helix blade configurations. Many other variations and modifications of the system and apparatus are possible. For instance, in the embodiments described herein, a variety of features including, without limitation, the number of blades (e.g., primary blades, secondary blades, etc.), the spacing between cutter elements, cutter element geometry and orientation (e.g., backrake, siderake, etc.), cutter element locations, cutter element extension heights, cutter element material properties, or combinations thereof may be varied among one or more primary cutter elements and/or one or more backup cutter elements. Accordingly, the scope of protection is not limited to the embodiments described herein, but is only limited by the claims that follow, the scope of which shall include all equivalents of the subject matter of the claims.

What is claimed is:

1. A drill bit for drilling a borehole in earthen formations, the bit comprising:

a bit body having a bit axis and a bit face including a cone region, a shoulder region, and a gage region;

a first primary blade extending radially along the bit face from the cone region to the gage region;

a plurality of cutter elements mounted to the first primary blade, wherein a first of the plurality of cutter elements has a planar cutting face and a second of the plurality of cutter elements has a convex cutting face; and wherein each cutting face of the first and the second of the plurality of cutter elements has a longitudinal axis that is forward facing relative to a direction of rotation of the drill bit, wherein the first of the plurality and the second of the plurality of cutter elements are primary cutter elements.

2. The drill bit of claim 1 wherein the second of the plurality of cutter elements is disposed in the cone region.

3. The drill bit of claim 1 wherein the second of the plurality of cutter elements is disposed in the gage region.

4. The drill bit of claim 1 wherein a third of the plurality of cutter elements has a planar cutting face and a fourth of the plurality of cutter elements has a convex cutting face.

5. The drill bit of claim 4 wherein the third and the fourth of the plurality of cutter elements are primary cutter elements, and wherein the second of the plurality of cutter elements and the fourth of the plurality of cutter elements are disposed in the cone region.

6. The drill bit of claim 4 wherein the third and the fourth of the plurality of cutter elements are primary cutter elements, and wherein the second of the plurality of cutter elements and the fourth of the plurality of cutter elements are disposed in the gage region.

7. The drill bit of claim 1 further comprising a secondary blade extending from the shoulder region to the gage region, and a plurality of cutter elements mounted to the secondary blade, wherein at least one of the cutter elements mounted to the secondary blade has a convex cutting face.

8. The drill bit of claim 1, wherein the convex cutting face has a diameter and a radius of curvature in the range of from one half the diameter of the convex cutting face to three times the diameter of the convex cutting face.

9. The drill bit of claim 8, wherein the radius of curvature is substantially constant.

10. The drill bit of claim 1, wherein the convex cutting face has a diameter and a radius of curvature in the range of from one half the diameter of the convex cutting face to one times the diameter of the convex cutting face.

11. A drill bit for drilling a borehole in earthen formations, the bit comprising:

a bit body having a bit axis and a bit face including a cone region, a shoulder region, and a gage region;

a first primary blade extending radially along the bit face from the cone region to the gage region;

a plurality of cutter elements mounted to the first primary blade, wherein a first of the plurality of cutter elements has a planar cutting face and a second of the plurality of cutter elements has a convex cutting face; and wherein each cutting face of the first and the second of the plurality of cutter elements has a longitudinal axis that is forward facing relative to a direction of rotation of the drill bit, wherein the first of the plurality of cutter elements is a primary cutter element and the second of the plurality of cutter elements is a backup cutter element.

12. The drill bit of claim 11 wherein the first of the plurality of cutter elements and the second of the plurality of cutter elements are disposed in the cone region.

13. The drill bit of claim 12 wherein each cutter element is disposed at a radial position relative to the bit axis, and wherein the radial position of the first of the plurality of cutter elements is different than the radial position of the second of the plurality of cutter elements.

14. The drill bit of claim 11 wherein a third of the plurality of cutter elements has a planar cutting face and a fourth of the plurality of cutter elements has a convex cutting face, the fourth of the plurality of cutter elements is a backup cutter element, and the third of the plurality of cutter elements is a primary cutter element.

15. The drill bit of claim 14 wherein the second of the plurality of cutter elements, the fourth of the plurality of cutter elements, the first of the plurality of cutter elements, and the third of the plurality of cutter elements are each disposed in the cone region.

16. The drill bit of claim 14 wherein the second of the plurality of cutter elements, the fourth of the plurality of cutter elements, the first of the plurality of cutter elements, and the third of the plurality of cutter elements are each disposed in the gage region.

17. A drill bit for drilling a borehole in earthen formations, the bit comprising:

a bit body having a bit axis and a bit face including a cone region, a shoulder region, and a gage region;

a plurality of primary blades, each primary blade extending radially along the bit face from the cone region to the gage region;

a plurality of secondary blades, each secondary blade extending radially along the bit face from the shoulder region to the gage region;

a plurality of a first type of cutter element mounted to each primary blade and each secondary blade, each of the first type of cutter elements has a planar cutting face;

a plurality of a second type of cutter element mounted to each primary blade, each of the second type of cutter elements has a convex cutting face; and wherein each cutting face of the first and the second of the plurality of cutter elements has a longitudinal axis that is forward facing relative to a direction of rotation of the drill bit.

18. The drill bit of claim 17 wherein each of the second type of cutter element is disposed in the cone region.

19. The drill bit of claim 18 wherein each of the second type of cutter element is a primary cutter element.

20. The drill bit of claim 18 wherein each of the second type of cutter element is a backup cutter element.

21. The drill bit of claim 17 wherein a first of the second type of cutter elements on each primary blade is disposed in the cone region and a second of the second type of cutter elements on each primary blade is disposed in the gage region.

22. The drill bit of claim 17 further comprising at least one of the second type of cutter elements mounted to each secondary blade.

23. The drill bit of claim 22 wherein each of the second type of cutter elements mounted to each secondary blade is disposed in the gage region.

24. The drill bit of claim 17, wherein the convex cutting face has a diameter and a radius of curvature in the range of from one half the diameter of the convex cutting face to three times the diameter of the convex cutting face.

25. The drill bit of claim 24, wherein the radius of curvature is substantially constant.

26. The drill bit of claim 18, wherein the convex cutting face has a diameter and a radius of curvature in the range of from one half the diameter of the convex cutting face to one times the diameter of the convex cutting face.

* * * * *